US012240565B2

(12) United States Patent
Kreuser et al.

(10) Patent No.: US 12,240,565 B2
(45) Date of Patent: Mar. 4, 2025

(54) SYSTEMS FOR ATTACHING ACCESSORIES TO A BOAT OR A MARINE ENVIRONMENT

(71) Applicant: Lexana, LLC, Lewis Center, OH (US)

(72) Inventors: Christopher Kreuser, Lewis Center, OH (US); Timothy Andrew Horn, Columbus, OH (US)

(73) Assignee: Lexana, LLC, Lewis Center, OH (US)

( * ) Notice: Subject to any disclaimer, the term of this patent is extended or adjusted under 35 U.S.C. 154(b) by 602 days.

(21) Appl. No.: 17/502,310

(22) Filed: Oct. 15, 2021

(65) Prior Publication Data

US 2022/0119076 A1 Apr. 21, 2022

Related U.S. Application Data

(60) Provisional application No. 63/092,922, filed on Oct. 16, 2020.

(51) Int. Cl.
*B63B 29/04* (2006.01)
*B63B 17/00* (2006.01)

(52) U.S. Cl.
CPC ..... *B63B 17/00* (2013.01); *B63B 2029/043* (2013.01)

(58) Field of Classification Search
CPC ..... B63B 17/00; B63B 2221/22; B63B 29/00; B63B 2029/022; B63B 2221/24; B63B 34/00; B63B 17/02; B63B 2017/026; B63B 32/80; B63B 32/86; B63B 32/83
See application file for complete search history.

(56) References Cited

U.S. PATENT DOCUMENTS

| | | | | |
|---|---|---|---|---|
| 2,829,660 | A * | 4/1958 | Wester | B63B 17/02 114/361 |
| 3,949,698 | A | 4/1976 | Sell | |
| 6,872,167 | B1 | 3/2005 | Meissner | |
| 10,494,067 | B1 | 12/2019 | Womack | |
| 11,858,591 | B2 * | 1/2024 | Ekern | B63B 17/02 |
| 2008/0244820 | A1 | 10/2008 | Moore | |
| 2020/0298936 | A1 * | 9/2020 | Fournier | B63B 34/00 |

OTHER PUBLICATIONS

The Extended European Search Report, Application No. 21202940.9, dated Mar. 14, 2022.

* cited by examiner

*Primary Examiner* — Andrew Polay
(74) *Attorney, Agent, or Firm* — MacMillan, Sobanski & Todd, LLC

(57) ABSTRACT

An example system for attaching accessories to a boat or a marine environment includes a first leg frame member, a second leg frame member, an attachment device, a first flexible support member, and a second flexible support member. Each of the first leg frame member and the second leg frame member has a base member, an intermediate member, and a top member. The intermediate member is attachable to the base member and the top member is attachable to the intermediate member. The attachment device is mountable to the first leg frame member and the second leg frame member. The first flexible support member is attachable to one of the first leg frame member and the attachment device. The second flexible support member is attachable to one of the second leg frame member and the attachment device.

16 Claims, 14 Drawing Sheets

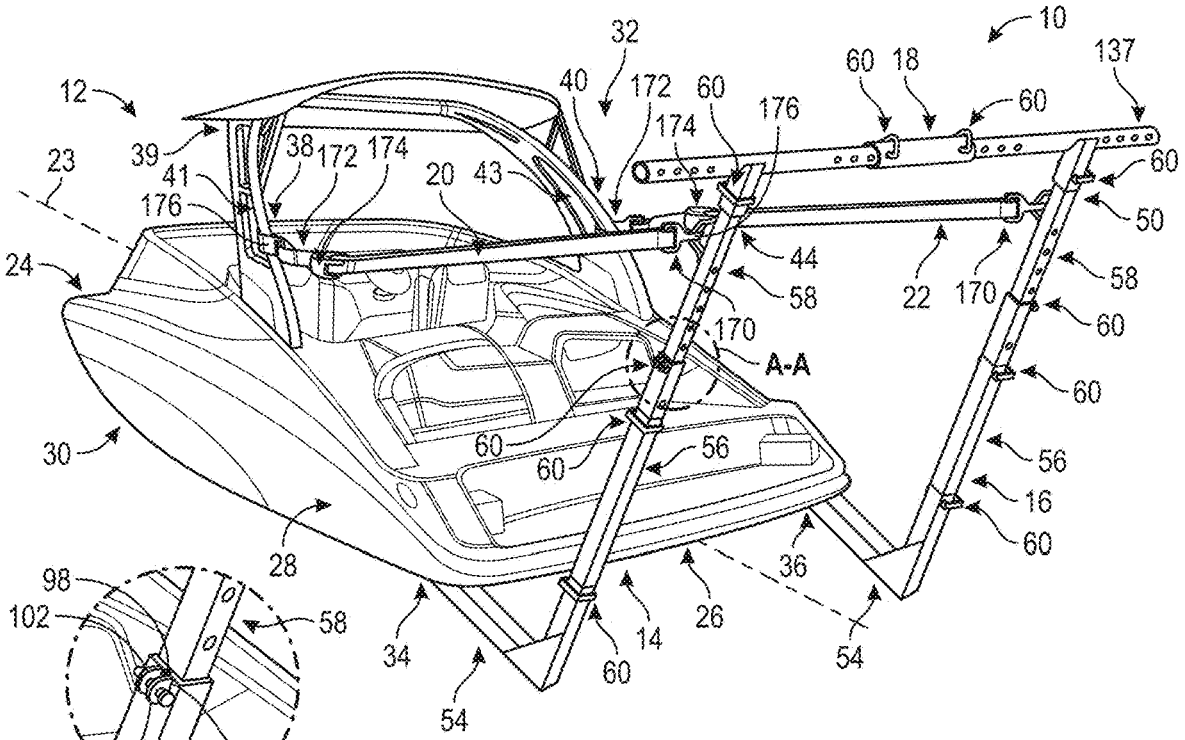
FIG. 1
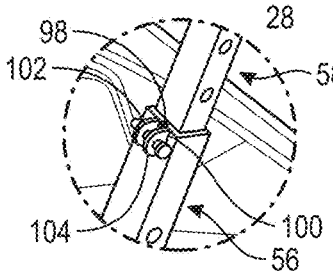
FIG. 1A
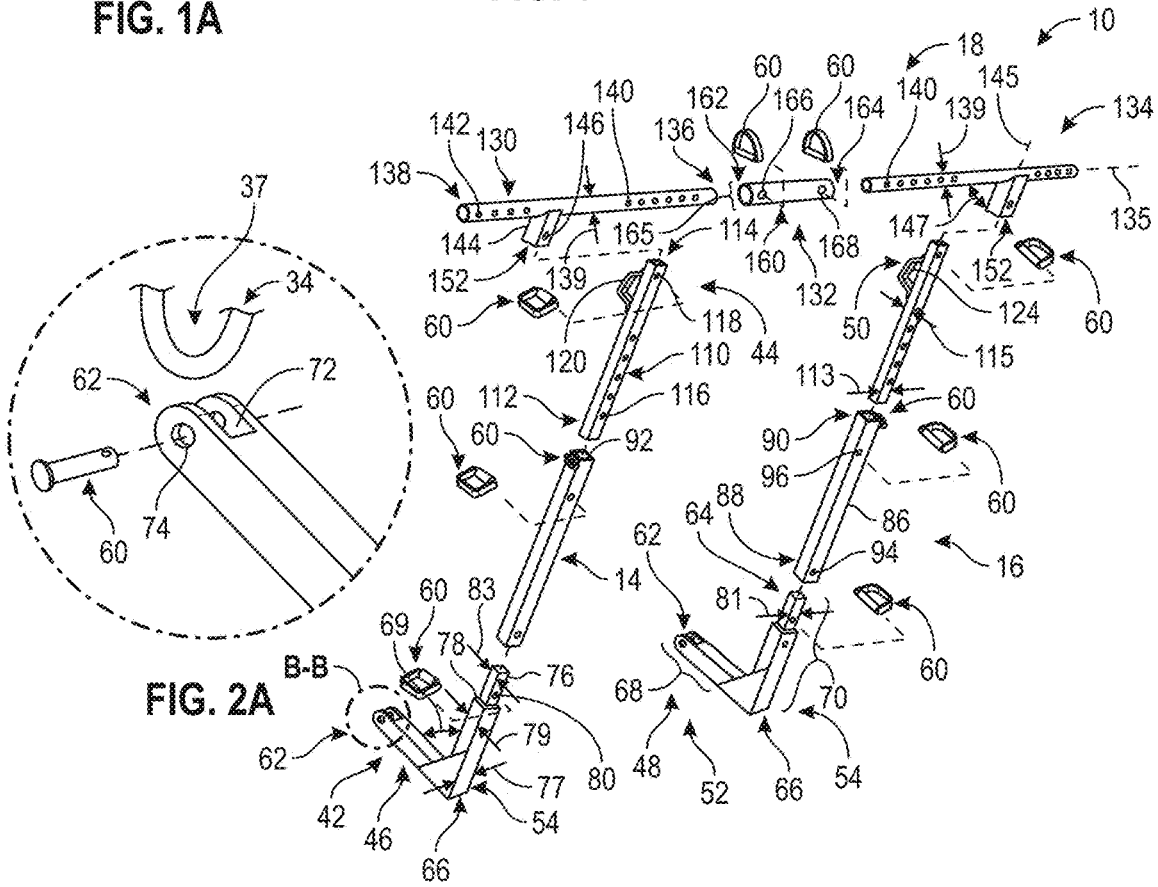
FIG. 2A
FIG. 2

SYSTEMS FOR ATTACHING ACCESSORIES TO A BOAT OR A MARINE ENVIRONMENT

FIELD

The disclosure relates generally to the field of watercrafts and marine environments. More particularly, the disclosure relates to systems for attaching accessories to a boat or a marine environment.

BACKGROUND

Conventionally, boats include a pre-defined area within which passengers can be seated and/or use to travel throughout a boat. This pre-defined area can be limited in size, which reduces the total number of passengers that can be seated on the boat, the number of experiences a passenger can engage in while on the boat, and the amount of storage provided to the passengers. As a result, there is often a need for additional seating and/or storage on a boat.

A need exists, therefore, for new and useful systems for attaching accessories to a boat.

SUMMARY

Various example systems for attaching accessories to a boat are described.

An example system for attaching accessories to a boat or a marine environment includes a first leg frame member, a second leg frame member, an attachment device, a first flexible support member, and a second flexible support member. The first leg frame member has a base member, an intermediate member, and a top member. The intermediate member of the first leg frame member is attachable to the base member of the first leg frame member. The top member of the first leg frame member is attachable to the intermediate member of the first leg frame member. The second leg frame member has a base member, an intermediate member, and a top member. The intermediate member of the second leg frame member is attachable to the base member of the second leg frame member. The top member of the second leg frame member is attachable to the intermediate member of the second leg frame member. The attachment device is mountable to the first leg frame member and the second leg frame member. The first flexible support member is attachable to one of the first leg frame member or the attachment device. The second flexible support member is attachable to one of the second leg frame member or the attachment device.

Additional understanding of these examples can be obtained by review of the detailed description, below, and the appended drawings.

BRIEF DESCRIPTION OF THE DRAWINGS

FIG. 1 is a perspective view of a first embodiment of a system for attaching accessories to a boat or a marine environment. The system is shown attached to a boat.

FIG. 1A is a magnified view of area A-A shown in FIG. 1.

FIG. 2 is a perspective exploded view of the system illustrated in FIG. 1.

FIG. 2A is a magnified view of area B-B shown in FIG. 2.

DETAILED DESCRIPTION

Figure 4:
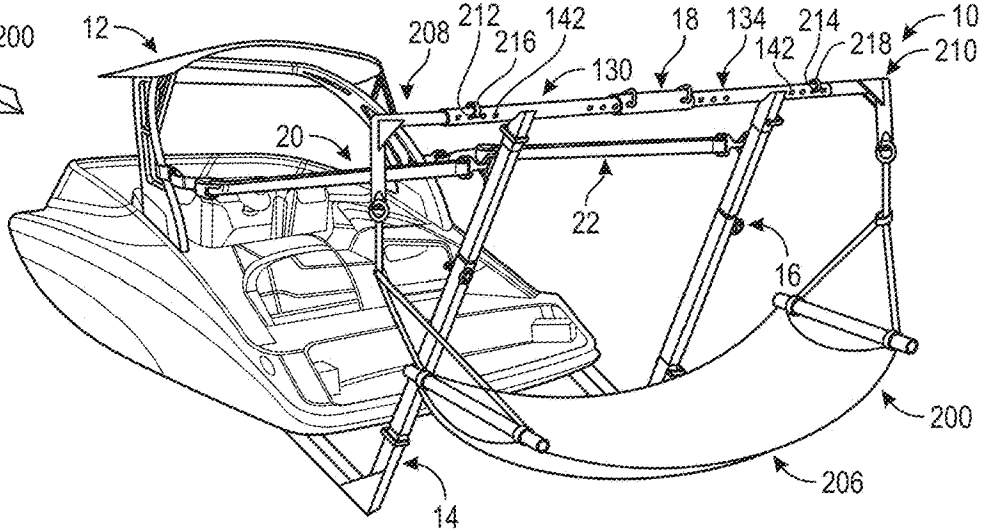
FIG. 4 is a partial perspective view of the system illustrated in FIG. 1. A hammock is attached to the system.

The following detailed description and the appended drawings describe and illustrate various example systems for attaching accessories to a boat. The description and illustration of these examples are provided to enable one skilled in the art to make and use a system for attaching accessories to a boat or a marine environment. They are not intended to limit the scope of the claims in any manner.

FIGS. 1, 1A, 2, 2A, 3, 4, 5, and 6 illustrate a first embodiment of a system for attaching accessories to a boat or a marine environment 10 attached to a boat 12. The system 10 is releasably mounted to the boat 12 and includes a first leg frame member 14, a second leg frame member 16, an attachment device 18 that is mountable to the first leg frame member 14 and the second leg frame member 16, a first flexible support member 20 that is attachable to one of the first leg frame member 14 or the attachment device 18, and a second flexible support member 22 that is attachable to one of the second leg frame member 16 or the attachment device 18. In the embodiment illustrated, the first flexible support member 20 is attached to the first leg frame member 14 and a second flexible support member 22 is attached to one of the second leg frame member 16.

A system for attaching accessories to a boat or a marine environment can be attached to any suitable boat or marine environment and selection of a boat or a marine environment to attach a system can be based on various considerations, such as the intended use of the system. Examples of marine environments to which a system for attaching accessories to a boat or a marine environment can be attached include docks, flat surfaces (e.g., those that are between about 60 inches and 90 inches wide), such as those adjacent a body of water, and any other marine environment considered suitable for a particular embodiment. In embodiments in which a system is attached to a marine environment, a mounting member, such as those described herein can include a portion of the marine environment, or a separate component (e.g., anchor) to which a portion of the system is attached. Examples of types of boats to which a system for attaching accessories to a boat or a marine environment can be attached include motorboats, sailboats, yachts, pontoons, and any other boat considered suitable for a particular embodiment. FIGS. 1, 3, 4, 5, and 6 illustrate an example boat 12 to which a system can be attached. In the illustrated embodiment, the boat 12 has a lengthwise axis 23, a bow 24, a stern 26 (e.g., first end), an aft portion 28, a port side 30 (e.g., first side), a starboard side 32 (e.g., second side), a first mounting member 34 (e.g., trailer hook), a second mounting member 36 (e.g., trailer hook), a third mounting member 38, and a fourth mounting member 40. In the illustrated embodiment, each of the first mounting member 34 and the second mounting member 36 is a D-ring that defines an opening 37, the third mounting member 38 is a portion of the wake tower 39, and the fourth mounting member 40 is a portion of the wake tower 39. The wake tower 39 defines a first opening 41 and a second opening 43. While the mounting members 34, 36, 38, 40 have been described as being positioned at particular locations and as having particular structural arrangements, a mounting member can comprise any suitable portion of a boat and be positioned at any suitable location. Examples of mounting members considered suitable to attach a portion of a system for attaching accessories to a boat or a marine environment include boat anchor points, trailer hoods, d-rings, openings defined by a portion of a boat (e.g., wake tower), and any other mounting member considered suitable for a particular embodiment.

A first leg frame member and a second leg frame member are capable of being mounted (e.g., removably, permanently) in an elevated position on any suitable portion of a boat, such as on a bow, a stern, an aft portion, a port side, and/or a starboard side. In the illustrated embodiment, the first leg frame member 14 is removably mounted in an elevated position on the stern 26 and port side 30 of the boat 12 and the second leg frame member 16 is removably mounted in an elevated position on the stern 26 and starboard side 30 of the boat 12.

The first leg frame member 14 has a proximal first end 42 and a distal first end 44 in opposed relationship to the proximal first end 42. The proximal first end 42 includes a first mounting mechanism 46 that is adapted to be mounted (e.g., removably, permanently) to the boat 12 and the distal first end 44 is adapted to be removably connected to the attachment device 18. The second leg frame member 16 has a proximal second end 48 and a distal second end 50 in opposed relationship to the proximal second end 48. The proximal second end 48 includes a second mounting mechanism 52 that is adapted to be mounted (e.g., removably, permanently) to the boat 12 and the distal second end 50 is adapted to be removably connected to the attachment device 18. As shown in FIG. 1, when assembled, each of the distal first end 44 and the distal second end 50 extends beyond an extent (e.g., stern 26) of the boat 12.

In the illustrated embodiment, each of the first leg frame member 14 and the second leg frame member 16 includes base member 54 (e.g., foot), an intermediate member 56 that is attachable to the base member 54, a top member 58 that is attachable to the intermediate member 56, and a plurality of attachment members 60. The base member 54 is releasably mounted to the boat 12, the intermediate member 56 is releasably attached to the base member 54, and the top member 58 is releasably attached to the intermediate member 56. While the first and second leg frame members 14, 16 have been illustrated as being identical to one another, a first leg frame member can include a structural arrangement that is different than a second leg frame member.

The base member 54 of the first leg frame member 14 comprises the first mounting mechanism 46 and the base member 54 of the second leg frame member 14 comprises the second mounting mechanism 52. The base member 54 has a first end 62, a second end 64, a bend 66, a first portion 68, a second portion 70, and defines a recess 72, a first set of coaxial openings 74, a projection 76, a shoulder 78, and a second set of coaxial openings 80. The first portion 68 extends from the first end 62 to the bend 66, is attached to the second portion 70, and is disposed at an angle 69 relative to the second portion 70. A first portion can be disposed at any suitable angle relative to a second portion, such as an acute angle, an obtuse angle, a right angle, and any other angle considered suitable for a particular embodiment. In the illustrated embodiment, the angle 69 is an obtuse angle. Each of the recess 72 and the set of coaxial openings 74 is disposed on the first portion 68. The recess 72 extends from the first end 62 toward the bend 66. The recess 72 of the base member 54 of the first leg frame member 14 is sized to receive a portion of the first mounting member 34 of the boat 12. The recess 72 of the base member 54 of the second leg frame member 16 is sized to receive a portion of the second mounting member 36 of the boat 12. Each opening of the first set of coaxial openings 74 is sized to receive a portion of an attachment member of the plurality of attachment members 60 such that releasable attachment to the boat 12 can be accomplished, as described herein. The second portion 70 extends from the bend 66 to the second end 64. Each of the projection 76, the shoulder 78, and the second set of coaxial openings 80 is disposed on the second portion 70. The second portion 70 has a first width 77 and a first depth 79 disposed between the bend 66 and the projection 76. The second portion 70 has a second width 81 and a second depth 83 disposed on the projection 76. The first width 77 and the first depth 79 are sized to prevent advancement of the intermediate member 56 beyond the shoulder 78. The second width 81 and the second depth 83 are sized such that the projection 76 can be disposed within the intermediate member 56. Each opening of the second set of coaxial openings 80 is disposed on the projection 76 and sized to receive a portion of an attachment member of the plurality of attachment members 60 to accomplish attachment between the base member 54 and the intermediate member 56.

The intermediate member 56 is releasably attached to the base member 54 and the top member 58. In the illustrated embodiment, the intermediate member 56 is an elongate tubular member 86 that has a first end 88, a second end 90, and defines a passageway 92, a first set of coaxial openings 94, a second set of coaxial openings 96, a notch 98, a first projection 100, a second projection 102, and a third set of coaxial openings 104. The passageway 92 is sized such that the base member 54 (e.g., the projection 76) and a portion of the top member 58 can be disposed within the passageway 92 of the intermediate member 56. In the illustrated embodiment, the passageway 92 has a width that is greater than the second width 81 of the base member 54 and greater than the first width 111 of the top member 58 and a depth that is greater than the second depth 83 of the base member 54 and greater than the first depth 113 of the top member 58. The first set of coaxial openings 94 is disposed near the first end 88 and each opening sized to receive a portion of an attachment member to accomplish attachment between the base member 54 and the intermediate member 56. The first set of coaxial openings 94 defined on the intermediate member 56 are coaxial with the second set of coaxial openings 80 defined by the base member 54 when the base member 54 and intermediate member 56 are assembled. Each opening of the second set of coaxial openings 96 is disposed between the first end 88 and the second end 90 and is sized to receive a portion of an attachment member of the plurality of attachment members 60 to accomplish attachment between the intermediate member 56 and the top member 58, as described herein. The notch 98 extends from the second end 90 of the intermediate member 56 toward the first end 88 and is disposed between the first projection 100 and the second projection 102. A first opening of the third set of coaxial openings 104 is disposed on the first projection 100 and a second opening of the third set of coaxial openings 104 is disposed on the second projection 102. Each opening of the third set of coaxial openings 104 is sized to receive a portion of an attachment member of the plurality of attachment members 60 to accomplish attachment between the intermediate member 56 and the top member 58, as described in more detail herein.

The top member 58 is releasably attached to the intermediate member 56. In the illustrated embodiment, the top member 58 is an elongate tubular member 110 that has a first end 112, a second end 114, a first width 113, a first depth 115, and defines a plurality of coaxial openings 116, a first set of coaxial openings 118, and a mounting bracket 120. The first width 113 and the first depth 115 are sized such that the top member 58 can be partially disposed within the passageway 92 of the intermediate member 56. Each opening of the plurality of coaxial openings 116 is disposed between the first end 112 and the second end 114 and is sized to receive a portion of an attachment member of the plurality of attachment members 60 to accomplish attachment between the intermediate member 56 and the top member 58. The height of the top member 58 relative to the boat 12 can vary depending on which set of openings of the plurality of coaxial openings 116 is aligned with the second set of coaxial openings 96 of the intermediate member 56 and through which an attachment member is disposed. As shown in FIG. 1, the top member 58 and the intermediate member 56 have a telescopic structural arrangement to accomplish customization of the height of the top member 58 relative to the boat 12. However, alternative embodiments can include any suitable structural arrangement between a top member and an intermediate member to accomplish customization of a height of a top member relative to a boat, such as using an arrangement opposite to the one illustrated, folding components, collapsing components, pivotable attachments between components, and/or separate removably connected components. Each opening of the first set of coaxial openings 118 is disposed near the second end 114 and is sized to receive a portion of an attachment member of the plurality of attachment members 60 to accomplish attachment between the top member 58 and the attachment device 18, as described in more detail herein. The mounting bracket 120 is disposed on a side of the top member 58 facing the boat 12 when the system 10 is assembled. The mounting bracket 120 defines a passageway 124 through which a portion of a flexible support member 20, 22 can be disposed. However, alternative embodiments can include any suitable structure on a top member to accomplish attachment between a top member and a flexible support member.

An attachment device included in a system for attaching accessories to a boat or a marine environment is capable of being removably mounted to a first leg frame member and a second leg frame member. In the embodiment illustrated, the attachment device 18 is removably mounted between the first leg frame member 14 and the second leg frame member 16 and is adapted for operable attachment of at least one accessory, as described in more detail herein. The attachment device 18 includes a first end member 130, an intermediate member 132, and a second end member 134. The intermediate member 132 is attachable to the first end member 130 and the second end member 132. When assembled, the attachment device 18 comprises a horizontal arm 137 that extends between the first leg frame member 14 and the second leg frame member 16.

Each of the first end member 130 and the second end member 134 has a lengthwise axis 135, a first end 136, a second end 138, an outside diameter 139, and defines a first plurality of coaxial openings 140, a second plurality of coaxial openings 142, a projection 144, and a set of coaxial openings 146. Each opening of the first plurality of coaxial openings 140 is disposed between the first end 136 and an axis 145 that extends through the projection 144. Each opening of the second plurality of coaxial openings 142 is disposed between the second end 138 and the axis 145 that extends through the projection 144. Each opening of the first plurality of coaxial openings 140 of the first end member 130 is sized to receive a portion of an attachment member of the plurality of attachment members 60 to accomplish attachment between the first end member 130 and the intermediate member 132 and/or is sized to receive a portion of an attachment member to accomplish attachment between the attachment device 18 and an accessory. Each opening of the first plurality of coaxial openings 140 of the second end member 134 is sized to receive a portion of an attachment member of the plurality of attachment members 60 to accomplish attachment between the second end member 134 and the intermediate member 132 and/or is sized to receive a portion of an attachment member to accomplish attachment between the attachment device 18 and an accessory. Each opening of the second plurality of coaxial openings 142 is sized to receive a portion of an attachment member of the plurality of attachment members 60 to accomplish attachment between the attachment device 18 and an accessory, as described in more detail herein. The projection 144 extends at an angle 147 relative to the lengthwise axis 135 and defines a passageway 152 that extends through the projection 144. The passageway 152 is sized such that a portion of the top member 58 can be disposed within the passageway 152 of the projection 144. The set of coaxial openings 146 is disposed on the projection 144. Each opening of the set of coaxial openings 146 of the first end member 130 is sized to receive a portion of an attachment member of the plurality of attachment members 60 to accomplish attachment between the attachment device 18 and the first leg frame member 14. Each opening of the set of coaxial openings 146 of the second end member 134 is sized to receive a portion of an attachment member of the plurality of attachment members 60 to accomplish attachment between the attachment device 18 and the second leg frame member 16.

The intermediate member 132 is a tubular member 160 that has a first end 162, a second end 164, an inside diameter 165, and defines a first set of coaxial openings 166 and a second set of coaxial openings 168. The inside diameter 165 of the intermediate member 132 is sized to receive a portion of the first end member 130 and the second end member 134. In the illustrated embodiment, the inside diameter 165 is greater than the outside diameter 139 of the first end member 130 and the outside diameter 139 of the second end member 134. The first set of coaxial openings 166 is disposed near the first end 162 and the second set of coaxial openings 168 is disposed near the second end 164. Each opening of the first set of coaxial openings 166 is sized to receive a portion of an attachment member of the plurality of attachment members 60 to accomplish attachment between the intermediate member 132 and the first end member 130. Each opening of the second set of coaxial openings 168 is sized to receive a portion of an attachment member of the plurality of attachment members 60 to accomplish attachment between the intermediate member 132 and the second end member 134. The overall length of the attachment device 18, and the distance between the first leg frame member 14 and the second leg frame member 16, can be customized depending on which set of openings of the first plurality of coaxial openings 140 of the first end member 130 and the second end member 134 are aligned with the first and second sets of coaxial openings 166, 168 and through which the attachment members are disposed. As shown in FIG. 1, the first end member 130 and the intermediate member 132 and the second end member 134 and the intermediate member 132 have a telescopic structural arrangement to accomplish customization of the length of the attachment device 18, and the distance between the first leg frame member 14 and the second leg frame member 16. However, alternative embodiments can include any suitable structural arrangement between an end member and an intermediate member to accomplish customization of a length of an attachment member, such as using an arrangement opposite to the one illustrated, folding components, collapsing components, pivotable attachments between components, and/or separate removably connected components. While a single attachment device 18 has been illustrated as included in the system for attaching accessories to a boat or a marine environment, a system can include any suitable number of attachment devices. Selection of a suitable number of attachment devices to include in a system for attaching accessories to a boat or a marine environment can be based on various considerations, including the intended use of the system. Examples of numbers of attachment devices considered suitable to include in a system for attaching accessories to a boat or a marine environment include one, at least one, two, a plurality, and any other number considered suitable for a particular embodiment.

While the first leg frame member 14, the second leg frame member 16, and the attachment device 18 have been illustrated as including multiple components and as having a particular structural arrangement, a leg frame member and/or an attachment device can include any suitable number of components and have any suitable structural arrangement. For example, alternative embodiments can include a leg frame member and/or attachment device that is formed as a single, unitary component that includes the various features described herein, that has a total width equal to between about 5 feet and about 8 feet, and/or that has a total height equal to between about 5 feet and about 8 feet.

A first flexible support member included in a system for attaching accessories to a boat or a marine environment is capable of being connected between a boat and one of a first leg frame member or an attachment device. A second flexible support member included in a system for attaching accessories to a boat or a marine environment is capable of being connected between a boat and one of a second leg frame member or an attachment device. In the embodiment illustrated, the first flexible support member 20 is adapted to connect the first leg frame member 14 with a first portion of the boat 12 that is spaced at a distance from the stern 26 and/or the port side 30 of the boat 12. The second flexible support member 22 is adapted to connect the second leg frame member 16 with a second portion of the boat 12 spaced at a distance from the stern 26 and/or starboard side 32 of the boat 12. As shown, the first flexible support member 20 is removably connected to the first leg frame member 14 and the third mounting member 38 disposed on the port side 30 of the boat 12 and the second flexible support member 22 is removably connected to the second leg frame member 16 and the fourth mounting member 40 disposed on the starboard side 32 of the boat 12. The second flexible support member 22 is opposably positioned from the first flexible support member 20 relative to the lengthwise axis 23 of the boat 12. Each of the first flexible support member 20 and the second flexible support member 22 has a first end 170, a second end 172, and an adjustment member 174. In the illustrated embodiment, each of the first end 170 and the second end 172 comprises a hook 176 that is sized to receive a portion of the boat 12 and/or the system 10. The adjustment member 174 can comprise any suitable component capable of allowing adjustment of a length of a flexible support member and capable of locking the length of the flexible support member. Thus, each of the first flexible support member 20 and the second flexible support member 22 has an adjustable length. Each of the first flexible support member 20 and the second flexible support member 22 accomplishes an additional attachment point between a leg frame member and a boat, maintains the position of a leg frame member relative to a boat, and absorbs some of the load of a leg frame member, an accessory, and/or a user disposed on an accessory.

A flexible support member can comprise any suitable component capable of providing attachment between a leg frame member and a boat and selection of suitable component can be based on various considerations, such as the intended use of the system for attaching accessories to a boat or a marine environment of which the flexible support member is a component. Examples of components considered suitable to utilize as a flexible support member include flexible webbings, straps (e.g., 1 inch, 2 inch), cargo straps, cables, semi-rigid members that are capable of flexing (e.g., elongated tubular members formed of a metal or plastic material), rigid members that are capable of flexing (e.g., elongated tubular members formed of a metal or plastic material), a component that does not include an adjustment member, nylon components, polyester components, those that include a d-ring instead of a hook, those that include a carabiner instead of a hook, combinations of those described herein, and any other component considered suitable for a particular embodiment.

To accomplish a method of assembling the system for attaching accessories to a boat or a marine environment 10 and attaching the system 10 to the boat 12, the first leg frame member 14 is assembled and attached to the boat 12, the second leg frame member 16 is assembled and attached to the boat 12, the attachment member 16 is assembled and attached to the first and second leg frame members 14, 16, the first flexible support member 20 is attached to the first leg member 14 and the boat 12, and the second flexible support member 22 is attached to the second leg member 16 and the boat 12. When assembled, the first and second leg frame members 14, 16 are disposed at an angle relative to a platform (e.g., swim platform) of the boat 12.

To accomplish assembly of the first leg frame member 14, the intermediate member 56 is attached to the base member 54 and the top member 58 is attached to the intermediate member 56. Attachment of the intermediate member 56 to the base member 54 is accomplished by advancing the intermediate member 56 over the projection 76 of the base member 54 until the intermediate member 56 contacts the shoulder 78. Then an attachment member of the plurality of attachment members 60 is advanced through the second set of coaxial openings 80 of the base member 54 and the first set of coaxial openings 94 of the intermediate member 56 such that the intermediate member 56 and the base member 54 become releasably attached to one another. Attachment of the top member 58 to the intermediate member 56 is accomplished by advancing the top member 58 into the passageway 92 of the intermediate member 56 until a desired set of openings of the plurality of coaxial openings 116 of the top member 58 is aligned with the second set of coaxial openings 96 of the intermediate member 56. Thus, the first leg frame member 14 is adjustable depending on how the various components are attached to one another. Then an attachment member of the plurality of attachment members 60 is advanced through the desired set of openings of the plurality of coaxial openings 116 of the top member 58 and the second set of coaxial openings 96 of the intermediate member 56 such that the top member 58 and the intermediate member 56 become releasably attached to one another. Then an attachment member of the plurality of attachment members 60 is advanced through the third set of coaxial openings 104 and tightened such that the first and second projections 100, 102 advanced toward one another and clamp onto the top member 58.

To accomplish assembly of the second leg frame member 16, the intermediate member 56 is attached to the base member 54 and the top member 58 is attached to the intermediate member 56. Attachment of the intermediate member 56 to the base member 54 is accomplished by advancing the intermediate member 56 over the projection 76 of the base member 54 until the intermediate member 56 contacts the shoulder 78. Then an attachment member of the plurality of attachment members 60 is advanced through the second set of coaxial openings 80 of the base member 54 and the first set of coaxial openings 94 of the intermediate member 56 such that the intermediate member 56 and the base member 54 become releasably attached to one another. Attachment of the top member 58 to the intermediate member 56 is accomplished by advancing the top member 58 into the passageway 92 of the intermediate member 56 until a desired set of openings of the plurality of coaxial openings 116 of the top member 58 is aligned with the second set of coaxial openings 96 of the intermediate member 56. Thus, the second leg frame member 16 is adjustable depending on how the various components are attached to one another. Then an attachment member of the plurality of attachment members 60 is advanced through the desired set of openings of the plurality of coaxial openings 116 of the top member 58 and the second set of coaxial openings 96 of the intermediate member 56 such that the top member 58 and the intermediate member 56 become releasably attached to one another. Then an attachment member of the plurality of attachment members 60 is advanced through the third set of coaxial openings 104 and tightened such that the first and second projections 100, 102 advanced toward one another and clamp onto the top member 58.

To accomplish attachment of the first leg frame member 14 to the boat 12, the base member 54 is positioned such that the first mounting member 34 of the boat 12 is disposed within the recess 72 defined by the base member 54. Then an attachment member of the plurality of attachment members 60 is advanced through the first set of coaxial openings 74 and the first mounting member 34 of the boat 12 such that the base member 54 becomes releasably attached to the first mounting member 34. To accomplish attachment of the second leg frame member 16 to the boat 12, the base member 54 is positioned such that the second mounting member 36 of the boat 12 is disposed within the recess 72 defined by the base member 54. Then an attachment member of the plurality of attachment members 60 is advanced through the first set of coaxial openings 74 and the second mounting member 36 of the boat 12 such that the base member 54 becomes releasably attached to the second mounting member 36. When attached to the boat 12, the distal first end 44 of the first leg frame member 14 and the distal second end 50 of the second leg frame member 16 extend beyond an extent (e.g., the stern 26) of the boat 12. The process of attaching the first leg frame member 14 and/or the second leg frame member 16 to the boat 12 can be accomplished prior, or subsequent, to assembling the first leg frame member 12, the second leg frame member 16, the attachment device 18, and/or attaching the attachment device 18 to the first and second leg frame members 12, 14.

To accomplish assembly of the attachment device 18, the first end member 130 is attached to the intermediate member 132 and the second end member 134 is attached to the intermediate member 132. Attachment of the first end member 130 to the intermediate member 132 is accomplished by advancing the first end member 130 into the intermediate member 132 until a desired set of openings of the first plurality of coaxial openings 140 is aligned with the first set of coaxial openings 166 of the intermediate member 132. Then an attachment member of the plurality of attachment members 60 is advanced through the desired set of openings of the first plurality of coaxial openings 140 and the first set of coaxial openings 166 of the intermediate member 56 such that the first end member 130 and the intermediate member 132 become releasably attached to one another. Attachment of the second end member 134 to the intermediate member 132 is accomplished by advancing the second end member 134 into the intermediate member 132 until a desired set of openings of the first plurality of coaxial openings 140 is aligned with the second set of coaxial openings 168 of the intermediate member 132. Then an attachment member of the plurality of attachment members 60 is advanced through the desired set of openings of the first plurality of coaxial openings 140 and the second set of coaxial openings 168 of the intermediate member 56 such that the second end member 134 and the intermediate member 132 become releasably attached to one another.

To accomplish assembly of the attachment device 18 to the first and second leg frame members 14, 16, the first end member 130 is attached to the first leg frame member 14 and the second end member 132 is attached to the second leg frame member 16. Attachment of the first end member 130 to the first frame member 14 is accomplished by advancing the top member 58 into the passageway 152 defined by the projection 144 of the first end member 130 until the first set of coaxial openings 118 of the top member 58 are aligned with the first set of coaxial openings 146 defined by the first end member 130. Then an attachment member of the plurality of attachment members 60 is advanced through the first set of coaxial openings 118 of the top member 58 and the first set of coaxial openings 146 defined by the first end member 130 such that the top member 58 and the first end member 130 become releasably attached to one another. Attachment of the second end member 134 to the second frame member 16 is accomplished by advancing the top member 58 into the passageway 152 defined by the projection 144 of the second end member 134 until the first set of coaxial openings 118 of the top member 58 are aligned with the first set of coaxial openings 146 defined by the second end member 134. Then an attachment member of the plurality of attachment members 60 is advanced through the first set of coaxial openings 118 of the top member 58 and the first set of coaxial openings 146 defined by the second end member 134 such that the top member 58 and the second end member 134 become releasably attached to one another. The process of attaching the attachment device 18 to the first leg frame member 14 and/or the second leg frame member 16 and/or assembling the attachment device 18 can be accomplished prior, or subsequent, to assembling the first leg frame member 14, the second leg frame member 16, attaching the first leg frame member 14 to the boat 12, and/or attaching the second leg frame member 16 to the boat 12.

To accomplish attachment of the first flexible support member 20 to the first leg member 14 and the boat 12 the first end 170 of the first flexible support member 20 is attached to the first leg member 14 and the second end 172 of the first flexible support member 20 is attached to the boat 12. In the illustrated embodiment, the hook 176 disposed on the first end 170 is positioned within the passageway 124 defined by the mounting bracket 120 of the top member 58 of the first leg frame member 14 and the hook 176 disposed on the second end 170 is positioned within an opening 41 defined by the third mounting member 38. Alternatively, a flexible support member can be wrapped around the a portion of a boat and attached to itself to accomplish attachment to a mounting member and/or a flexible support member can be wrapped around the top member and attached to itself to accomplish attachment to a top member in embodiments in which a mounting bracket is omitted from a top member. To accomplish attachment of the second flexible support member 22 to the second leg member 16 and the boat 12 the first end 170 of the second flexible support member 22 is attached to the second leg member 16 and the second end 172 of the second flexible support member 22 is attached to the boat 12. In the illustrated embodiment, the hook 176 disposed on the first end 170 is positioned within the passageway 124 defined by the mounting bracket 120 of the top member 58 of the second leg frame member 16 and the hook 176 disposed on the second end 170 is positioned within an opening 43 defined by the fourth mounting member 40. Optionally, the first and second flexible support members 20, 22 can be adjusted using the adjustment member 174 to tighten or loosen the attachment between the leg frame members 14, 16 and the boat 12. In alternative embodiments, a flexible support member can include any suitable structure on an end to accomplish attachment to a mounting member (e.g., latching hook).

Figure 3:
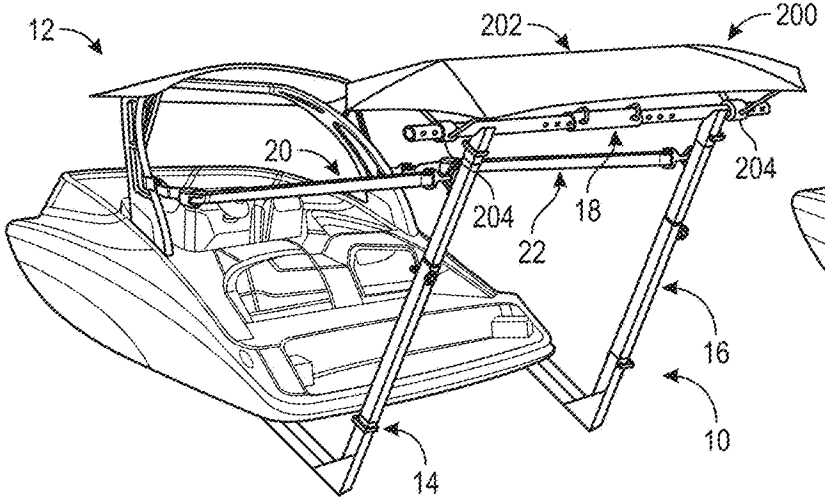
FIG. 3 is a partial perspective view of the system illustrated in FIG. 1. A canopy is attached to the system.
Figure 6:
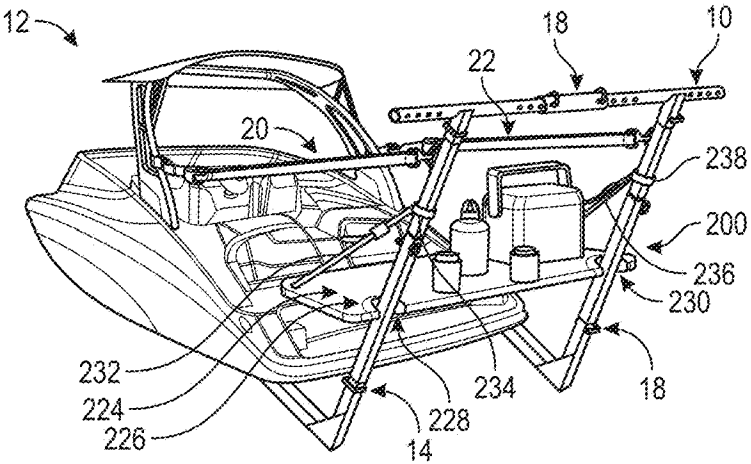
FIG. 6 is a partial perspective view of the system illustrated in FIG. 1. A platform is attached to the system.
Figure 5:
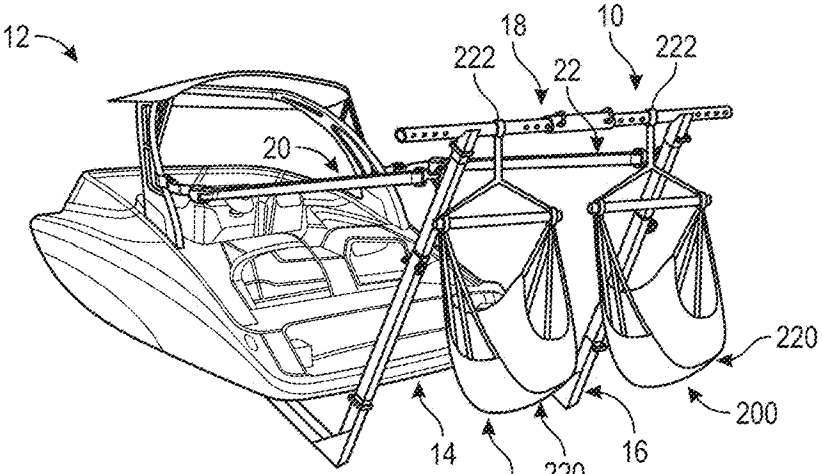
FIG. 5 is a partial perspective view of the system illustrated in FIG. 1. A set of chairs is attached to the system.

As shown in FIGS. 3, 4, 5, and 6, an accessory 200 can be attached, or attachable, to the system 10 using any suitable technique or method of attachment. Any suitable accessory can be attached to a system for attaching accessories to a boat or a marine environment and selection of a suitable accessory can be based on various considerations, such as the intended use of the system of which the accessory is a component. Examples of accessories considered suitable to attach to a system for attaching accessories to a boat or a marine environment include hammocks, chairs, swings, sun shades, canopies, rain shelters, platforms, storage platforms, cargo nets, tables, storage containers, drink holders, cooler holders, hand bars, and any other accessory considered suitable for a particular embodiment. For example, an accessory can be selected from the group consisting of a hammock, a chair, and a platform. FIG. 3 shows a canopy 202 that includes ring members 204 removably attached to the system 10. Attachment of the canopy 202 to the system 10 can be accomplished by sliding the ring members 204 of the canopy over the attachment device 18. FIG. 4 shows a hammock 206 removably installed on the system 10. Attachment of the hammock 206 to the system 10 can be accomplished by attaching the hammock 206 to a first extension arm 208 and a second extension arm 210. The first extension arm 208 includes a first set of coaxial openings 212 and the second extension arm 210 includes a second set of coaxial openings 214. The first extension arm 208 is positioned within the first end member 130 of the attachment device 18 and an attachment member 216 is passed through the set of coaxial openings 212 and a set of openings of the second plurality of coaxial openings 142 of the first end member 130. The second extension arm 210 is positioned within the second end member 134 of the attachment device 18 and an attachment member 218 is passed through the set of coaxial openings 214 and a set of openings of the second plurality of coaxial openings 142 of the second end member 134. While extension arms 208, 210 have been illustrated, a system can omit one or more extension arms such that a hammock can be directly attached to an end member or an intermediate member of an attachment device. FIG. 5 shows a set of chairs 220 attached to the system 10, each of which includes a ring member 222. Attachment of each of the chairs 220 to the system 10 can be accomplished by sliding the ring members 222 of the chair over the attachment device 18. FIG. 6 shows a platform 224 attached to the system 10. The platform 224 includes a base 226 that defines first and second recesses 228, 230, a first support arm 232 that includes a ring member 234, and a second support arm 236 that includes a ring member 238. Attachment of the platform 224 to the system 10 can be accomplished by positioning the ring member 234 of the first support arm 232 on the first leg frame member 14, positioning the ring member 238 of the second support arm 236 on the second leg frame member 16, positioning the first recess 228 on the first leg frame member 14, and positioning the second recess 230 on the second leg frame member 16. While particular types of attachment between an accessory and a system have been illustrated, any suitable type of attachment between an accessory and a system can be utilized. Any accessory described herein can be attached to any suitable system for attaching an accessory to a boat or a marine environment, such as those described herein.

An attachment member included in a system for attaching accessories to a boat or a marine environment can include any suitable type of attachment member having any suitable structural arrangement and selection of a suitable attachment member to include in a system for attaching accessories to a boat or a marine environment can be based on various considerations, including the intended use of the system. Examples of attachment members considered suitable to include in a system for attaching accessories to a boat or a marine environment include threaded members, threaded members that include a knob, bolts and nuts, pins, wire-lock pins, and any other attachment member considered suitable for a particular embodiment. In the illustrated embodiment, the attachment members passed through the third set of coaxial openings 104 of the intermediate member 56 are bolts and nuts and the remainder of the attachment members are wire-lock pins. In alternative embodiments, the openings through which an attachment member is passed can be threaded and the attachment member can be threaded such that a threaded attachment between the components can be accomplished.

A first leg frame member, a second leg frame member, an attachment device, a first flexible support member, a second flexible support member, an attachment member, and a mounting member can be formed of any suitable material. Selection of a suitable material to form a first leg frame member, a second leg frame member, an attachment device, a first flexible support member, a second flexible support member, an attachment member, and/or a mounting member can be based on various considerations, including the type of accessory intended to be attached to the system. Examples of materials considered suitable to form a first leg frame member, a second leg frame member, an attachment device, a first flexible support member, a second flexible support member, an attachment member, and/or a mounting member include metals, plastics, natural materials, and any other material considered suitable for a particular embodiment.

Figure 7:
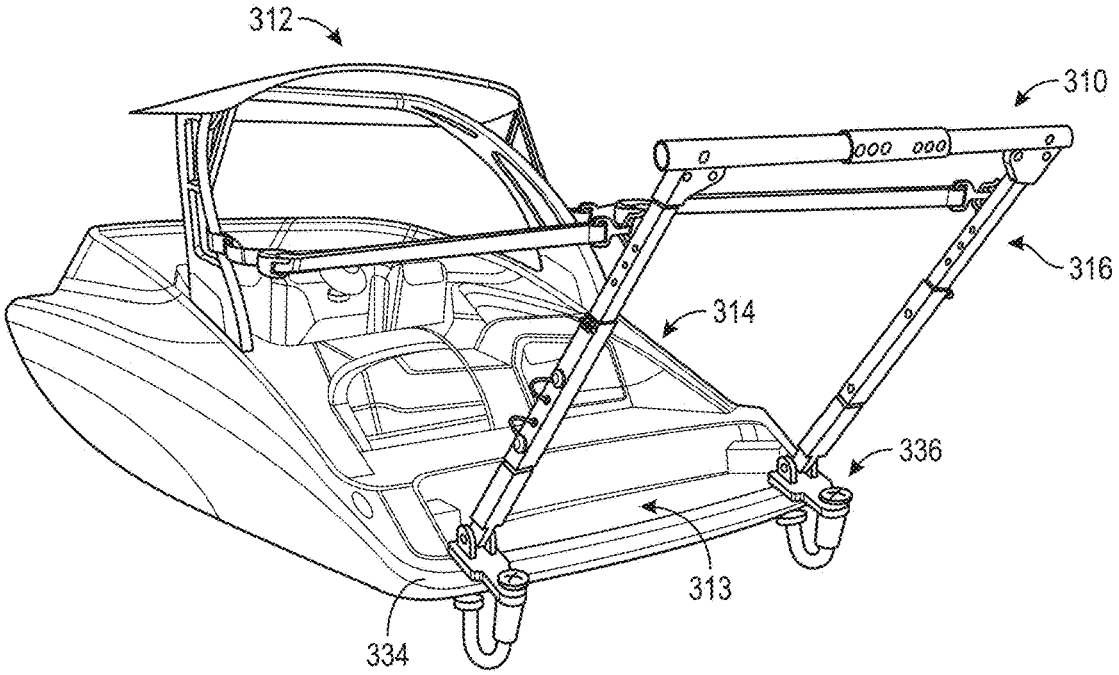
FIG. 7 is a perspective view of a second embodiment of a system for attaching accessories to a boat or a marine environment. The system is shown attached to a boat.
Figure 8:
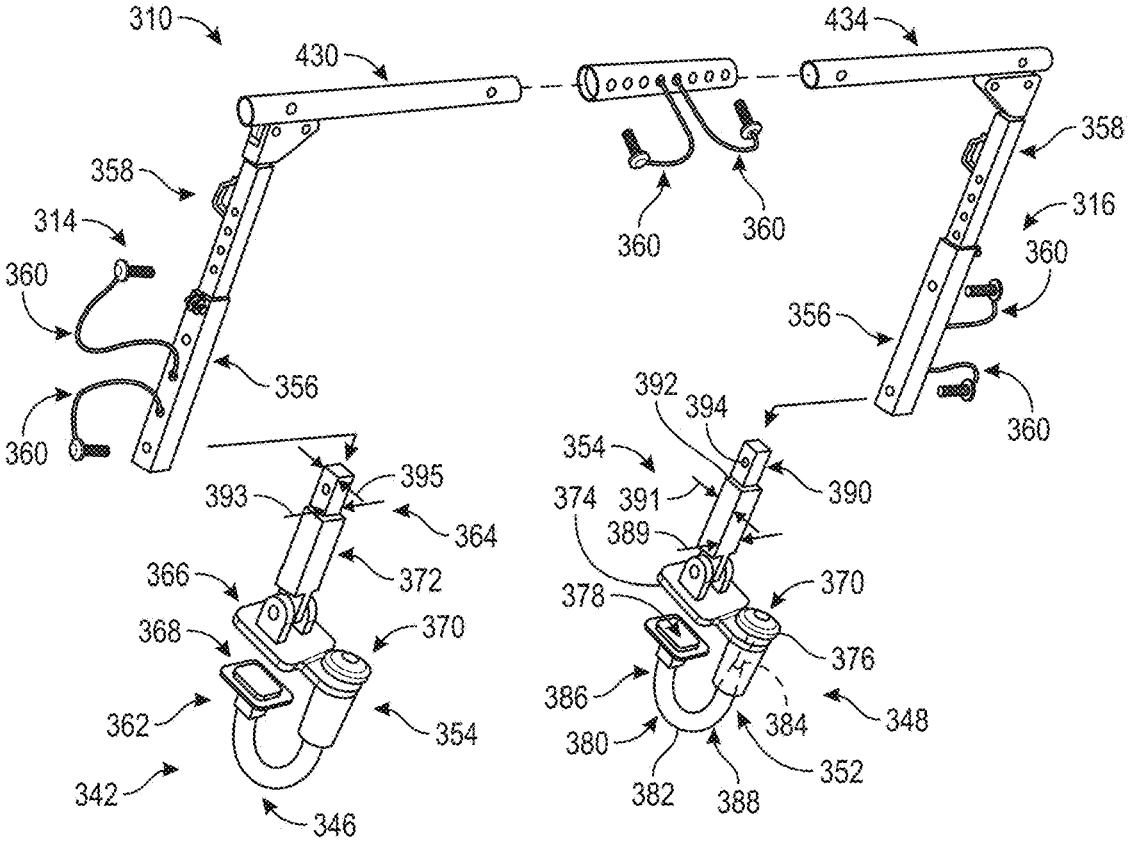
FIG. 8 is a perspective exploded view of the system illustrated in FIG. 7.

FIGS. 7 and 8 illustrate a second embodiment of a system for attaching accessories to a boat or a marine environment 310 attached to a boat 312.

In the illustrated embodiment, the first mounting member 334 and the second mounting member 336 is a swim platform 313 of the boat 312, the proximal first end 342 includes a first mounting mechanism 346 that is adapted to be removably mounted to the swim platform 313, and the proximal second end 348 includes a second mounting mechanism 352 that is adapted to be removably mounted to the swim platform 313. In addition, the first end member 430 is pivotably attached to the first leg frame member 314 (e.g., the top member 358) and the second end member 434 is pivotably attached to the second leg frame member 316 (e.g., the top member 358). Each of the first end member 430 and the second end member 434 can be moved from an extended position, as shown in FIGS. 7 and 8, and a collapsed position in which it is disposed parallel to the top member 358 to allow for storage of the system 310 when not in use.

The base member 354 of the first leg frame member 314 comprises the first mounting mechanism 346 and the base member 354 of the second leg frame member 316 comprises the second mounting mechanism 352, which are adjustable to accommodate different dimensions and/or geometries of the portion of a boat to which the base member 354 is attached. The base member 354 has a first end 362, a second end 364, a first plate member 366, a second plate member 368 releasably attached to the first plate member 366, an adjustment member 370, and an arm 372. The first plate member 366 defines a first contact surface 374 and a passageway 376 through which a portion of the second plate member 368 is disposed. The second plate member 368 is moveably attached to first plate member 366 and defines a second contact surface 378, a support 380 that defines a bend 382, and a threaded opening 384 within which the adjustment member 370 is partially disposed. Optionally, a first contact surface 374 and/or second contact surface 378 can include a material that is soft relative to the material forming the remaining portion of the base member 354 to prevent damage to the boat during assembly and/or use. When assembled, the support 380 is disposed through the passageway 376 defined by the first plate member 366. The bend 382 positions a first portion 386 of the support 380 substantially parallel with a second portion 388 of the support 380. The arm 372 is pivotably attached to the first plate member 366 and includes a projection 390, a shoulder 392, and a set of coaxial openings 394. The arm 372 has a first width 389 and a first depth 391 disposed between the first plate member 366 and the projection 390. The arm 372 has a second width 393 and a second depth 395 disposed on the projection 390. The first width 389 and the first depth 391 are sized to prevent advancement of the intermediate member 356 beyond the shoulder 392. The second width 393 and the second depth 395 are sized such that the projection 390 can be disposed within the intermediate member 356. Each opening of the set of coaxial openings 394 is disposed on the projection 390 and is sized to receive a portion of an attachment member of the plurality of attachment members 360 to accomplish attachment between the base member 354 and the intermediate member 356. In the illustrated embodiment, the each attachment member of the plurality of attachment members is a pin that can be disposed through one or more openings.

The first and second contact surfaces 374, 378 are adapted to provide contact between the base member 354 and the swim platform 313 to accomplish attachment between the base member 354 and the swim platform 313. Attachment can be accomplished by positioning the first plate member 366 over the top of the swim platform 313, positioning the second plate member 368 under the bottom of the swim platform 313, advancing the base member 354 toward the boat 312 until a throat portion of the base member 354 contacts the boat 312, positioning the support 380 of the second plate member 368 within the passageway 376 of the first plate member 366, positioning the adjustment member 370 within the threaded opening 384, and rotating the adjustment member 370 (e.g., between about 1 inch and about 6 inches) to advance the first and second plate members 366, 368 toward one another such that they tighten against the swim platform 313 clamping the base member 354 onto the swim platform 313. The first mounting mechanism 346 and the second mounting mechanism 352 provide a mechanism for securing the system 310 to the swim platform 313 in a manner in which a majority, or all, of the weight of the system and any attached accessories and/or users is loading on top of the swim platform 313.

Figure 9A:
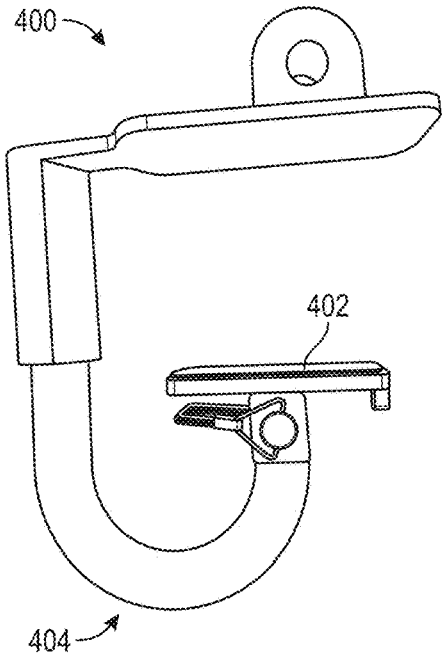
FIG. 9A is a perspective view of an alternative mounting mechanism that can be included in a system for attaching accessories to a boat or a marine environment.

FIG. 9A illustrates an alternative mounting mechanism 400 that can be included in a system for attaching accessories to a boat or a marine environment. The mounting mechanism 400 can be included on a first leg frame member and/or a second leg frame member and is similar to the mounting member 346 described above, except as detailed below. In the illustrated embodiment, the second plate member 402 is pivotably attached to the support 404.

Figure 9B:
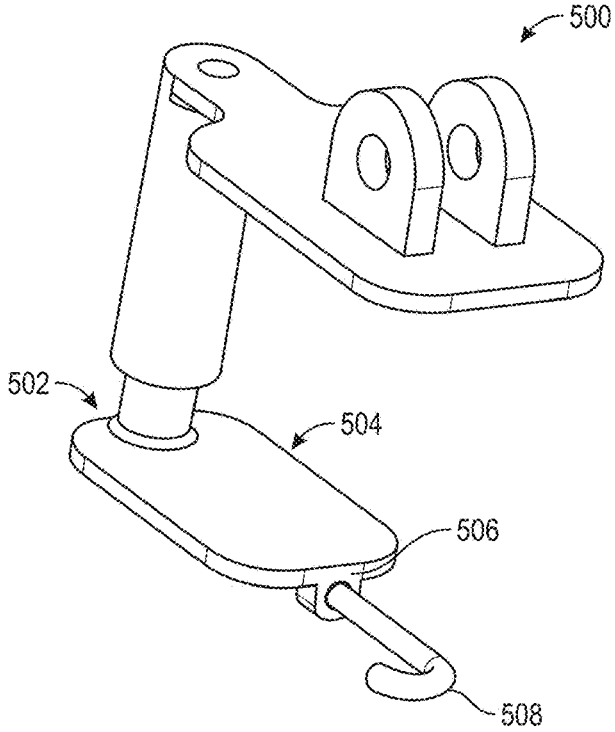
FIG. 9B is a perspective view of another alternative mounting mechanism that can be included in a system for attaching accessories to a boat or a marine environment.

FIG. 9B illustrates an alternative mounting mechanism 500 that can be included in a system for attaching accessories to a boat or a marine environment. The mounting mechanism 500 can be included on a first leg frame member and/or a second leg frame member and is similar to the mounting member 346 described above, except as detailed below. In the illustrated embodiment, the support 502 positions the second plate member 504 at about a 90 degree angle relative to the support 502. The second plate member 504 defines a passageway 506 through which a hook 508 is disposed. The hook 508 is adapted to interact with a mounting member of a boat to accomplish a secondary point of attachment between a boat and a system for attaching accessories to a boat or a marine environment in addition to clamping the mounting mechanism on a swim platform of the boat.

Figure 9C:
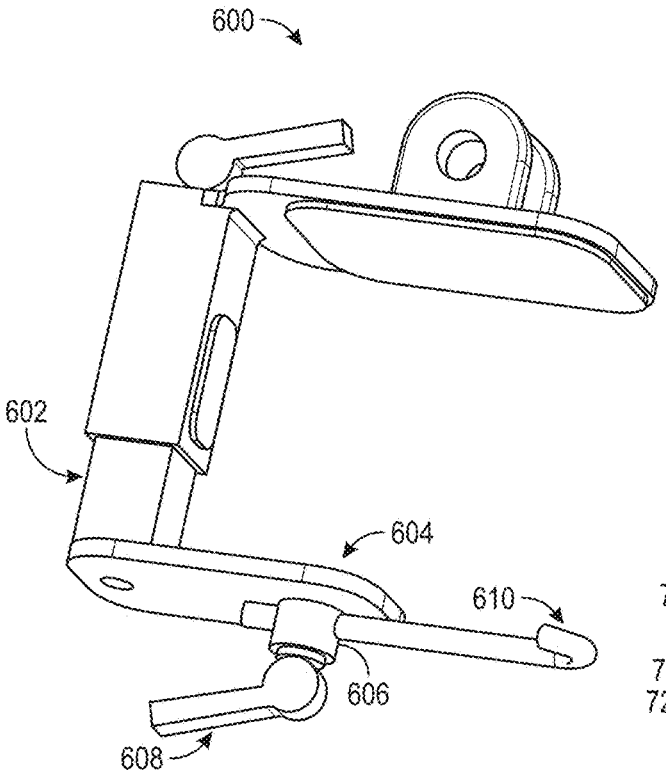
FIG. 9C is a perspective view of another alternative mounting mechanism that can be included in a system for attaching accessories to a boat or a marine environment.

FIG. 9C illustrates an alternative mounting mechanism 600 that can be included in a system for attaching accessories to a boat or a marine environment. The mounting mechanism 600 can be included on a first leg frame member and/or a second leg frame member and is similar to the mounting member 400 described above, except as detailed below.

In the illustrated embodiment, the support 602 positions the second plate member 604 at about a 90 degree angle relative to the support 602. The second plate member 604 defines a passageway 606 and includes a locking member 608. A hook 610 is disposed, and moveable, through the passageway 606. The locking member 608 is moveable between a first, locked position and a second, unlocked position. The hook 610 is moveable within the passageway 606 when the locking member 608 is in the second, unlocked position. The hook 610 is fixed within the passageway 606 when the locking member 608 is in the first, locked position. The hook 610 is adapted to interact with a mounting member of a boat to accomplish a secondary point of attachment between a boat and a system for attaching accessories to a boat or a marine environment in addition to clamping the mounting mechanism on a swim platform of the boat.

Figure 9D:
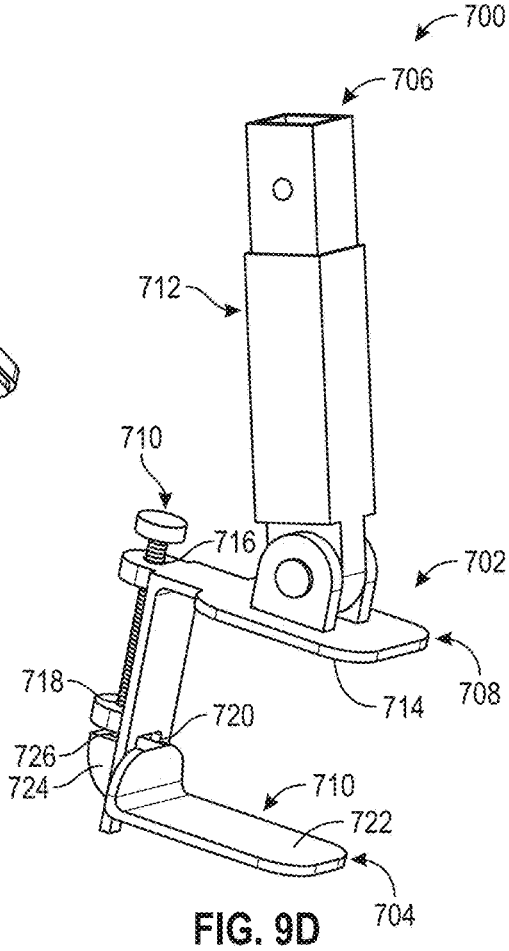
FIG. 9D is a perspective view of another alternative mounting mechanism that can be included in a system for attaching accessories to a boat or a marine environment.

FIG. 9D illustrates an alternative mounting mechanism 700 that can be included in a system for attaching accessories to a boat or a marine environment. The mounting mechanism 700 can be included on a first leg frame member and/or a second leg frame member and is similar to the mounting member 346 described above, except as detailed below.

In the illustrated embodiment, the base member 702 has a first end 704, a second end 706, a first plate member 708, a second plate member 710 releasably attached to the first plate member 708, an adjustment member 710 (e.g., quick cam), and an arm 712. The first plate member 708 defines a first contact surface 714, a first opening 716, a second opening 718, and a recess 720 within which a portion of the second plate member 710 is disposed. The second plate member 710 is moveably attached to first plate member 708 and defines a second contact surface 722, a support 724, and a threaded opening 726 disposed on the support 724 and within which the adjustment member 710 is partially disposed. When assembled, the support 724 is disposed within the recess 720 defined by the first plate member 708.

The first and second contact surfaces 714, 722 are adapted to provide contact between the base member 702 and a portion of the boat to accomplish attachment between the base member 702 and the boat. Attachment can be accomplished by positioning the first plate member 714 over a first portion of a portion of the boat, positioning the second plate member 722 under a second portion of the portion of the boat, positioning the support 724 of the second plate member 722 within the recess 720 of the first plate member 714, positioning the adjustment member 710 through the first and second openings 716, 718 and within the threaded opening 726, and rotating the adjustment member 710 to advance the first and second plate members 714, 722 toward one another such that they tighten against the portion of the boat clamping the base member 702 onto the boat.

Figure 9E:
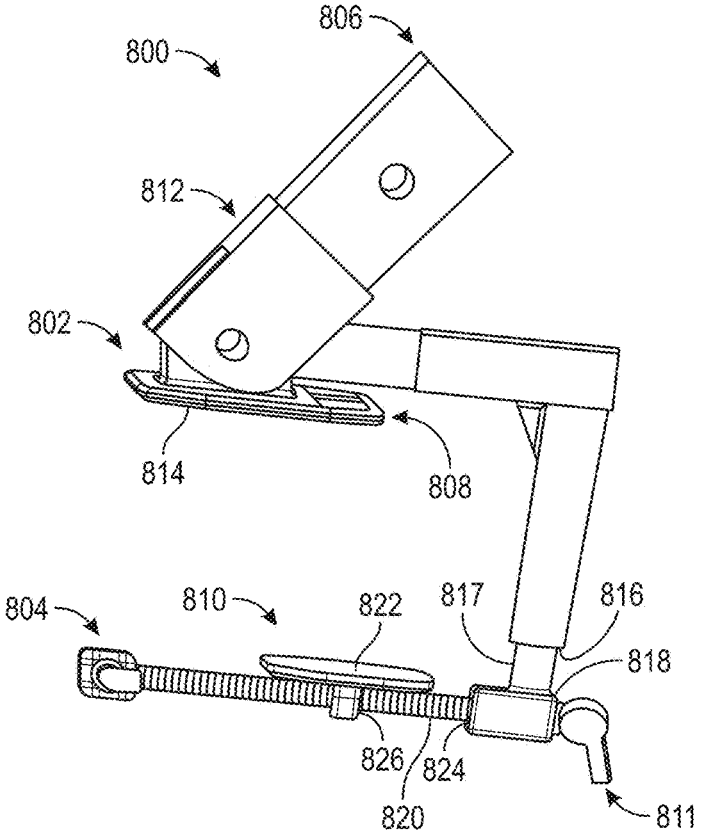
FIG. 9E is a perspective view of another alternative mounting mechanism that can be included in a system for attaching accessories to a boat or a marine environment.

FIG. 9E illustrates an alternative mounting mechanism 800 that can be included in a system for attaching accessories to a boat or a marine environment. The mounting mechanism 800 can be included on a first leg frame member and/or a second leg frame member and is similar to the mounting member 346 described above, except as detailed below.

In the illustrated embodiment, the base member 802 has a first end 804, a second end 806, a first plate member 808, a second plate member 810 releasably attached to the first plate member 808, an adjustment member 811, and an arm 812. The first plate member 808 defines a first contact surface 814 and a recess 816 within which a portion of the second plate member 810 is disposed. The second plate member 810 is moveably attached to first plate member 808 and has a support 817 that defines a bend 818, a threaded member 820, a second contact surface 822, and defines a threaded opening 824 within which the adjustment member 810 is partially disposed, and a threaded opening 826 adjacent the second contact surface 822. The threaded member 820 is moveably disposed within the threaded opening 826. The second contact surface 822 is disposed on the threaded member 820 and its position can be adjusted upon movement of the threaded member 820 by the adjustment member 811. When assembled, the support 816 is partially disposed within the recess 816 defined by the first plate member 808.

Figure 10:
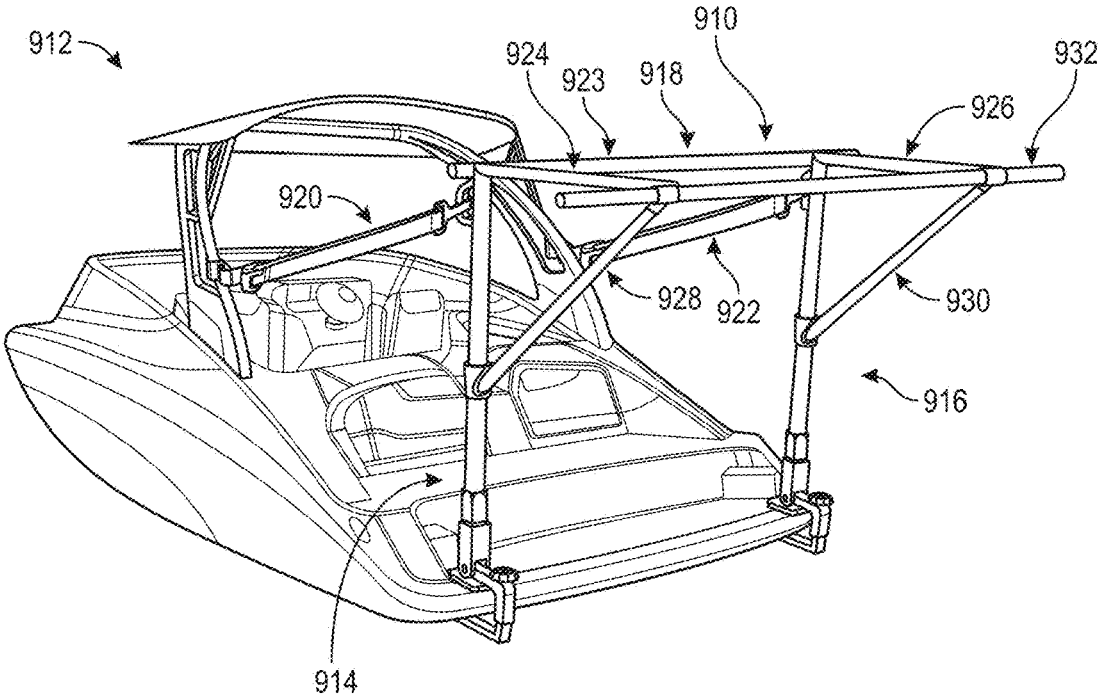
FIG. 10 is a partial perspective view of a third embodiment of a system for attaching accessories to a boat or a marine environment. The system is shown attached to a boat.

FIG. 10 illustrates a third embodiment of a system for attaching accessories to a boat or a marine environment 910 attached to a boat 912. The system 910 is similar to the system 310 illustrated in FIGS. 7 and 8 and described above, except as detailed below. The system 910 is releasably mounted to the boat 912 and includes a first leg frame member 914, a second leg frame member 916, an attachment device 918, a first flexible support member 920, and a second flexible support member 922.

In the illustrated embodiment, the attachment device 918 includes a first support member 923, a first extension member 924, a second extension member 926, a first bracing member 928, a second bracing member 930, and a second support member 932 (e.g., horizontal arm). The first extension member 924 is connected to the first leg frame member 914 (e.g., distal first end) and the first support member 923. The second extension member 926 is connected to the second leg frame member 916 (e.g., distal second end) and the first support member 923. The first bracing member 928 is connected to the first leg frame member 914 (e.g., between the proximal first end and the distal first end) and the first extension member 924. The second bracing member 930 is connected to the second leg frame member 916 (e.g., between the proximal second end and the distal second end) and the second extension member 926. The second support member 932 is attached to the first extension member 924, the second extension member 926, the first bracing member 928, and the second bracing member 930. As shown in FIG. 10, when assembled, the second support member 932 extends beyond an extent (e.g., stern 934) of the boat 912 a distance (e.g., equal to about 36 inches) and the first and second leg frame members 914, 916 are disposed at a right angle relative to a platform (e.g., swim platform) of the boat 912.

Figure 11:
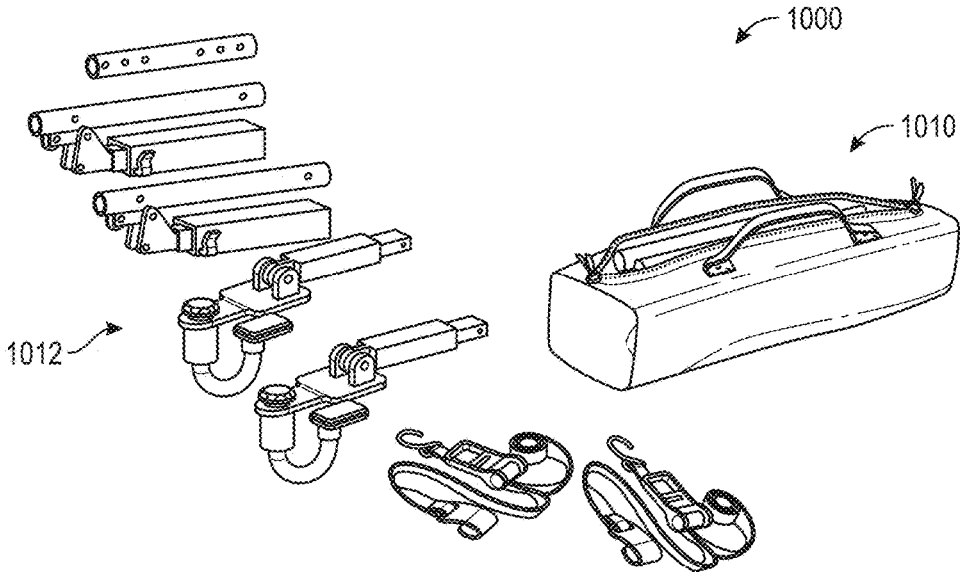
FIG. 11 is a perspective view of a first embodiment of a kit that includes a system for attaching accessories to a boat or a marine environment.

FIG. 11 illustrates a kit 1000 that includes a system for attaching accessories to a boat or a marine environment. The kit 1000 includes a storage container 1010 and a system for attaching accessories to a boat or a marine environment 1012, as shown in FIGS. 7 and 8.

The storage container 1010 provides storage for the system 1012 when not in use. The system 1012 is sized and configured such that is can be housed within the storage container 1010 when disassembled and not in use. The telescoping and foldable arrangements between the various components allows for easy transportation and carrying. In addition, these arrangements provide a mechanism for easily storing the kit on a boat when not in use and/or shipping the kit to third parties. While a particular system for attaching accessories to a boat or a marine environment has been illustrated as included in the kit, any suitable number and type system for attaching an accessory to a boat or a marine environment can be included in a kit, such as those described herein. In addition, a kit can optionally include one or more accessories for attachment to a system included in the kit.

Figure 12:
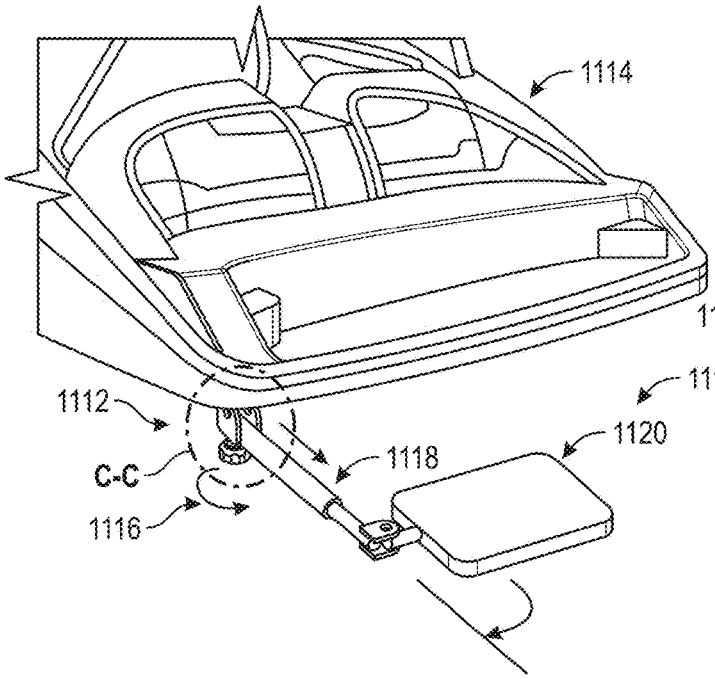
FIG. 12 is a perspective view of a first embodiment of a water seat.
Figure 12A:
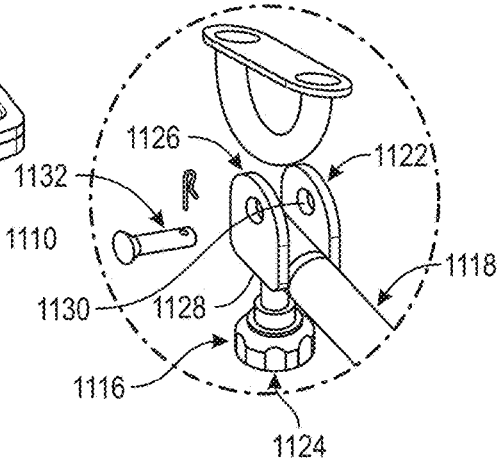
FIG. 12A is a magnified view of area C-C shown in FIG. 12.

FIGS. 12 and 12A illustrate an example water seat 1110 can be attached to a mounting member 1112 of a boat 1114.

In the illustrated embodiment, the water seat 1110 comprises a locking member 1116, a support arm 1118, and a platform 1120. The locking member 1116 includes a plate 1122 and an adjustment member 1124. The plate 1122 defines a recess 1126, a threaded opening 1128, and a set of coaxial openings 1130 adapted to receive an attachment member 1132. The support arm 1118 is disposed within the recess 1126 and attached to the platform 1120. Upon advancement of the adjustment member 1124 into the threaded opening 1128, the support arm 1118 becomes attached to the boat 1114. The platform 1120 is pivotably attached to the support arm 1118 and can optionally include a locking member to lock its position relative to the support arm 1118 during use. The water seat 1110 provides a mechanism to allow a user to be seated (e.g., over water, underwater) on the platform 1120 while the boat 1114 is in use. While shown as being positioned on the port side of the boat 1114, a water seat can be positioned at any suitable location on a boat (e.g., starboard side).

Figure 13B:
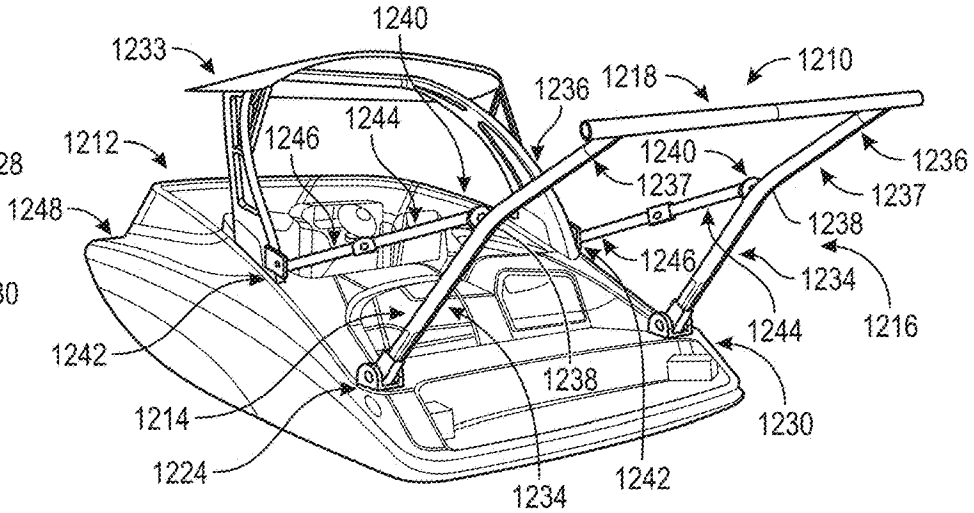
FIG. 13B is another perspective view of the system illustrated in FIG. 13A. The system is shown attached to a boat and in a second, expanded configuration.
Figure 13A:
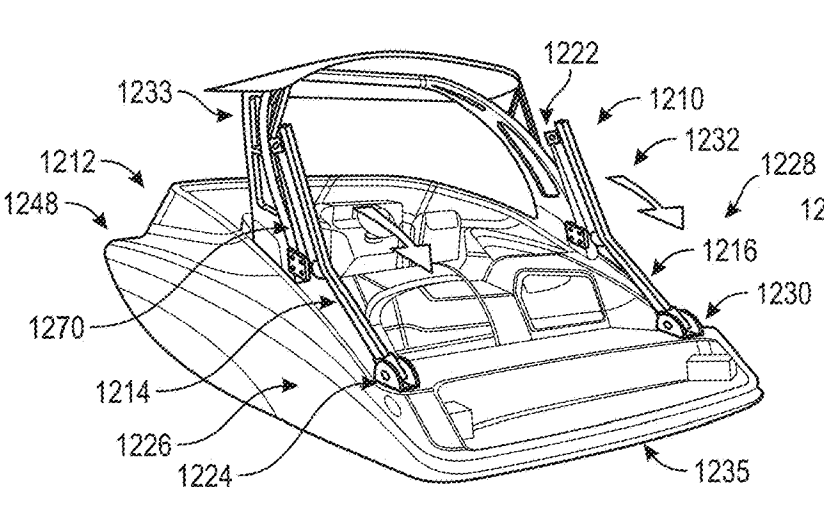
FIG. 13A is a perspective view of a fourth embodiment of a system for attaching accessories to a boat or a marine environment. The system is shown attached to a boat and in a first, stored configuration. The attachment device has been removed from the system.

FIGS. 13A and 13B illustrate a fourth embodiment of a system for attaching accessories to a boat or a marine environment 1210 attached to a boat 1212. The system 1210 is similar to the system 10 illustrated in FIGS. 1, 2, and 2A and described above, except as detailed below. The system 1210 is permanently mounted to the boat 1212 and includes a first leg frame member 1214, a second leg frame member 1216, an attachment device 1218, a first flexible support member 1220, and a second flexible support member 1222. The system 1210 is moveable between a first, stored configuration, as shown in FIG. 13A, and a second, expanded (e.g., in use) configuration, as shown in FIG. 13B.

The proximal first end 1224 of the first leg frame member 1214 (e.g., base member) is pivotably attached to a port side 1226 aft portion 1228 of the boat 1212 (e.g., boat hull) and the proximal second end 1230 of the second leg frame member 1214 (e.g., base member) is pivotably attached to a starboard side 1232 aft portion 1228 of the boat 1212 (e.g., boat hull). In the illustrated embodiment, the proximal first end 1224 of the first leg frame member 1214 is pivotably attached to the boat 1212 between the wake tower 1233 and the stern 1235 and the proximal second end 1230 of the second leg frame member 1214 is pivotably attached to the boat 1212 between the wake tower 1233 and the stern 1235. The intermediate member 1237 of each of the first leg frame member 1214 and the second leg frame member 1216 has a first portion 1234, a second portion 1236, and defines a bend 1238 that positions the first portion 1234 at an angle relative to the second portion 1236.

Each of the first flexible support member 1220 and the second flexible support member 1222 has a first end 1240, a second end 1242, a first portion 1244, and a second portion 1246. The second end 1242 of the first flexile support member 1220 is pivotably attached to a port side 1226 of the boat 1212 (e.g., boat hull) between the first leg frame member 1214 and the bow 1248 and the first end 1240 is pivotably attached to the first leg frame member 1214. The second end 1242 of the second flexile support member 1222 is pivotably attached to a starboard side 1232 of the boat 1212 (e.g., boat hull) between the second leg frame member 1216 and the bow 1248 and the first end 1240 is pivotably attached to the second leg frame member 1216. In the illustrated embodiment, the second end 1242 of the first flexile support member 1220 is pivotably attached to the wake tower 1233 and the second end 1242 of the second flexile support member 1222 is pivotably attached to the wake tower 1233. The attachments described with respect to system 1210 can be accomplished by a manufacturer or a boat owner.

Figure 14B:
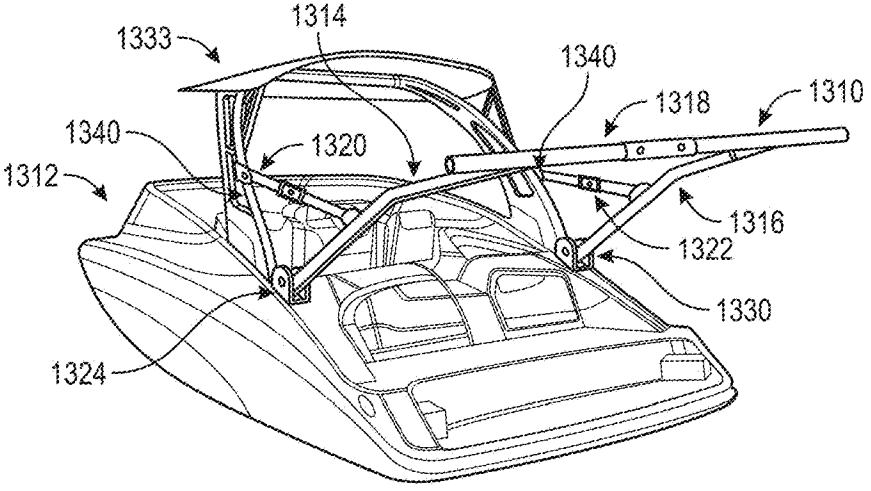
FIG. 14B is another perspective view of the system illustrated in FIG. 14A. The system is shown attached to a boat and in a second, expanded configuration.
Figure 14A:
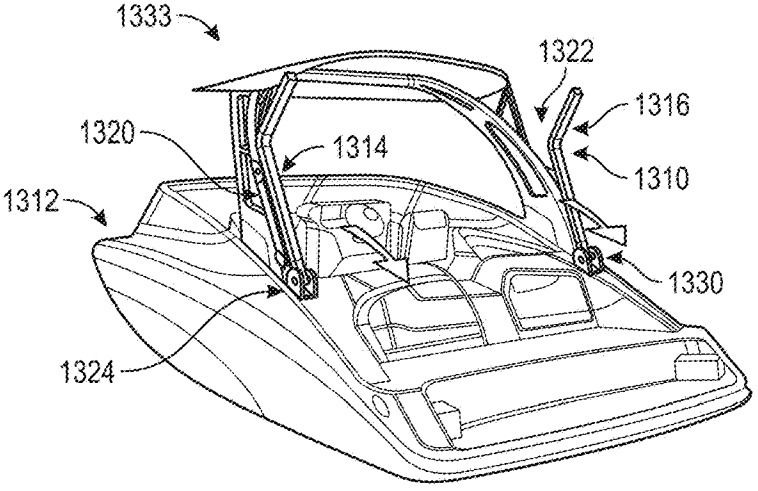
FIG. 14A is a perspective view of a fifth embodiment of a system for attaching accessories to a boat or a marine environment. The system is shown attached to a boat and in a first, stored configuration. The attachment device has been removed from the system.

FIGS. 14A and 14B illustrate a fifth embodiment of a system for attaching accessories to a boat 1310 attached to a boat 1312 or a marine environment. The system 1310 is similar to the system 1210 illustrated in FIGS. 13A and 13B and described above, except as detailed below. The system 1310 is permanently mounted to the boat 1312 and includes a first leg frame member 1314, a second leg frame member 1316, an attachment device 1318, a first flexible support member 1320, and a second flexible support member 1322. The system 1310 is moveable between a first, stored configuration, as shown in FIG. 14A, and a second, expanded (e.g., in use) configuration, as shown in FIG. 14B.

In the illustrated embodiment, the proximal first end 1324 of the first leg frame member 1314 (e.g., base member) is pivotably attached to the boat 1312 adjacent to the wake tower 1333, the proximal second end 1330 of the second leg frame member 1314 (e.g., base member) is pivotably attached to the boat 1312 adjacent to the wake tower 1333, the first end 1340 of the first flexile support member 1320 is pivotably attached to a first vertical support of the wake tower 1333 and the first end 1340 of the second flexile support member 1322 is pivotably attached to a second vertical support of the wake tower 1333. The attachments described with respect to system 1310 can be accomplished by a manufacturer or a boat owner.

Figure 15:
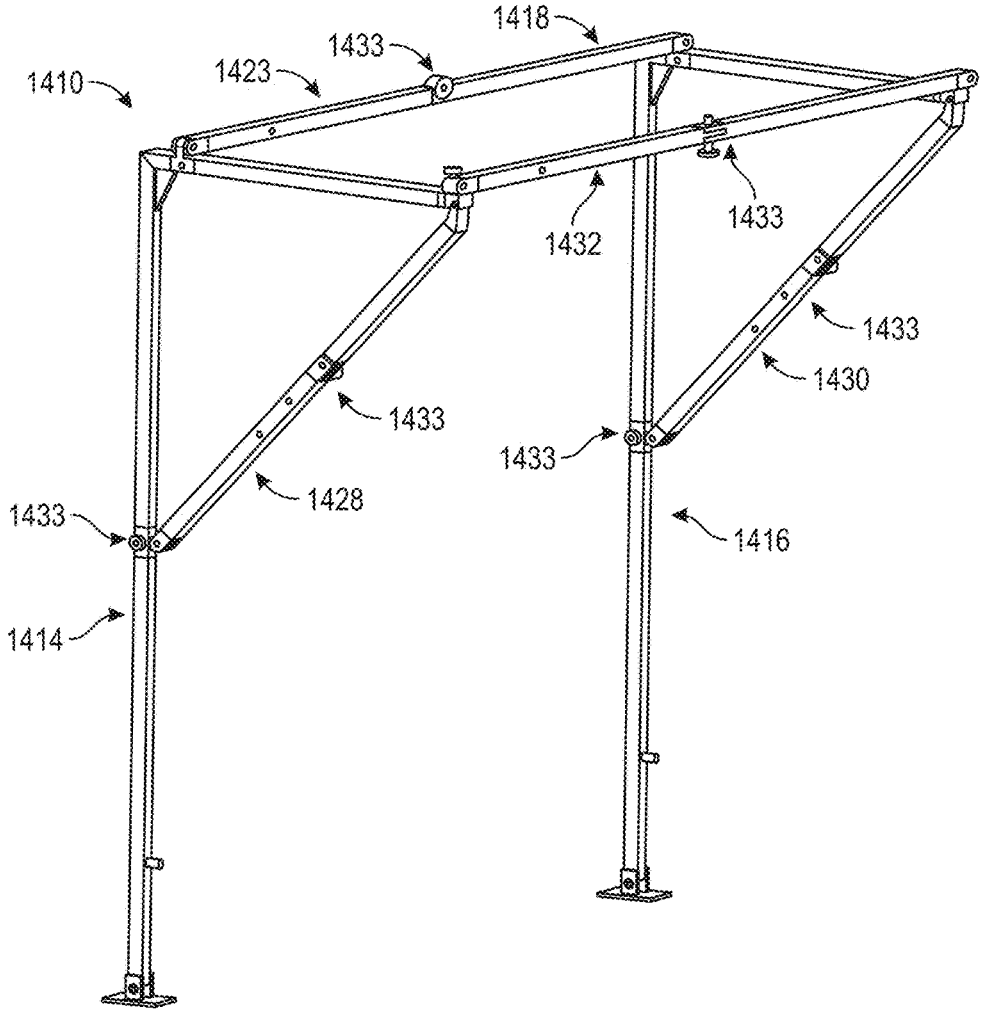
FIG. 15 is a perspective view of a sixth embodiment of a system for attaching accessories to a boat or a marine environment. The system is shown in a first, expanded configuration.
Figure 16:
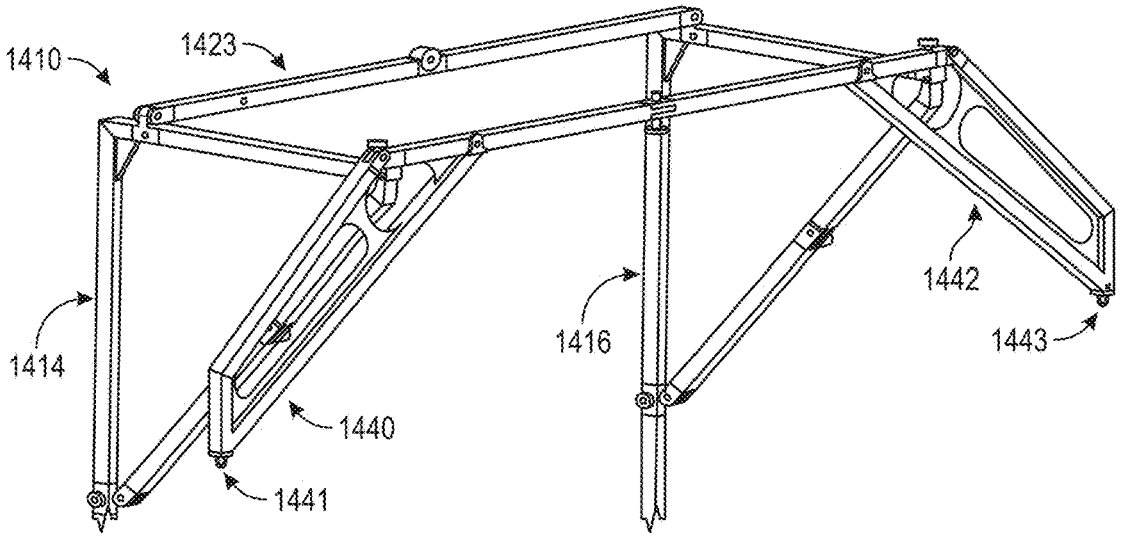
FIG. 16 is a partial perspective view of the system illustrated in FIG. 15. The system is illustrated with first and second extension members.
Figures 17A, 17B, 17C, 17D, 17E:
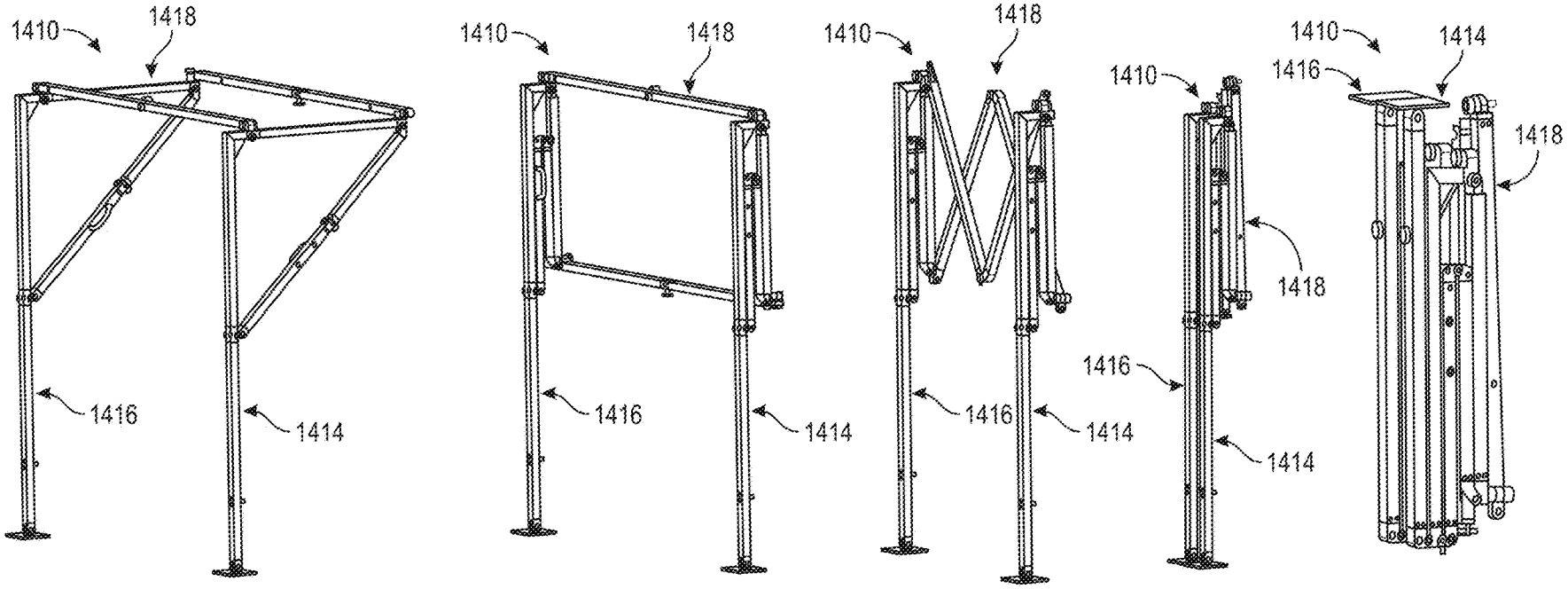
FIG. 17A is another perspective view of the system illustrated in FIG. 15. The system is shown in a first, expanded configuration.
FIG. 17B is another perspective view of the system illustrated in FIG. 15. The system is shown in a second, partially-collapsed configuration.
FIG. 17C is another perspective view of the system illustrated in FIG. 15. The system is shown in a third, partially-collapsed configuration.
FIG. 17D is another perspective view of the system illustrated in FIG. 15. The system is shown in a fourth, partially-collapsed configuration.
FIG. 17E is another perspective view of the system illustrated in FIG. 15. The system is shown in a fifth, collapsed configuration.

FIGS. 15, 16, 17A, 17B, 17C, 17D, and 17E illustrate a sixth embodiment of a system for attaching accessories to a boat or a marine environment 1410. The system 1410 is similar to the system 910 illustrated in FIG. 10 and described above, except as detailed below. The system 1410 includes a first leg frame member 1414, a second leg frame member 1416, an attachment device 1418, a first flexible support member (not shown), and a second flexible support member (not shown). The system 1410 is moveable between a first, expanded configuration, as shown in FIGS. 15, 16, and 17A, and a second, collapsed configuration, as shown in FIG. 17E.

In the illustrated embodiment, each of the first leg frame member 1414, a second leg frame member 1416, the first support member 1423, the first bracing member 1428, the second bracing member 1430, and the second support member 1432 includes a lockable hinge 1433 that allows the system 1410 to move between the expanded configuration and the collapsed configuration. Optionally, as shown in FIG. 16, the system 1410 can include a first extension member 1440 and a second extension member 1442, each of which can be attached to the attachment member 1418 (e.g., the second support member 1432). Inclusion of first and second extension members 1440, 1442 positions the mounting points 1441, 1443 for an accessory (e.g., a hammock) on the attachment member 1418 outwardly and away from the first and second leg frame members 1414, 1416.

FIGS. 18 through 35 illustrate a seventh embodiment of a system for attaching accessories to a boat 1510 or a marine environment. The system 1510 is similar to the system 10 illustrated in FIGS. 1, 1A, 2, 2A, 3, 4, 5, and 6 and described above, except as detailed below. The system 1510 includes a first leg frame member 1514, a second leg frame member 1516, an attachment device 1518, a first flexible support member 1520, a second flexible support member 1522, a third flexible support member 1525, and a fourth flexible support member 1527.

The boat 1512 has a lengthwise axis 1523, a bow 1524, a stern 1526, an aft portion 1528, a port side 1530, a starboard side 1532, a swim platform 1533, a first mounting member 1534, a second mounting member 1536, a third mounting member 1538, and a fourth mounting member 1540. In the illustrated embodiment, each of the first mounting member 1534 and the second mounting member 1536 is a trailer hook, the third mounting member 1538 is a portion of the wake tower 1539, and the fourth mounting member 1540 is a portion of the wake tower 1539. The wake tower 1539 defines a first opening 1541 and a second opening 1543.

Figure 18:
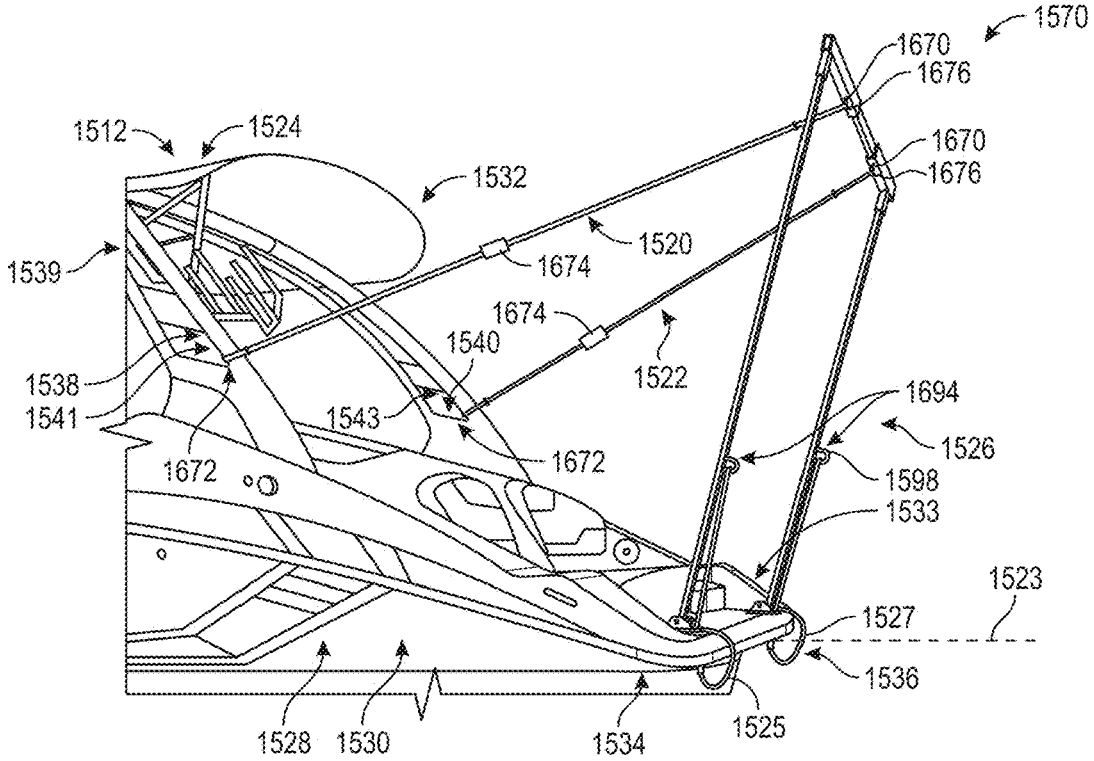
FIG. 18 is a partial perspective view of a seventh embodiment of a system for attaching accessories to a boat or a marine environment. The system is shown attached to a boat.
Figure 19:
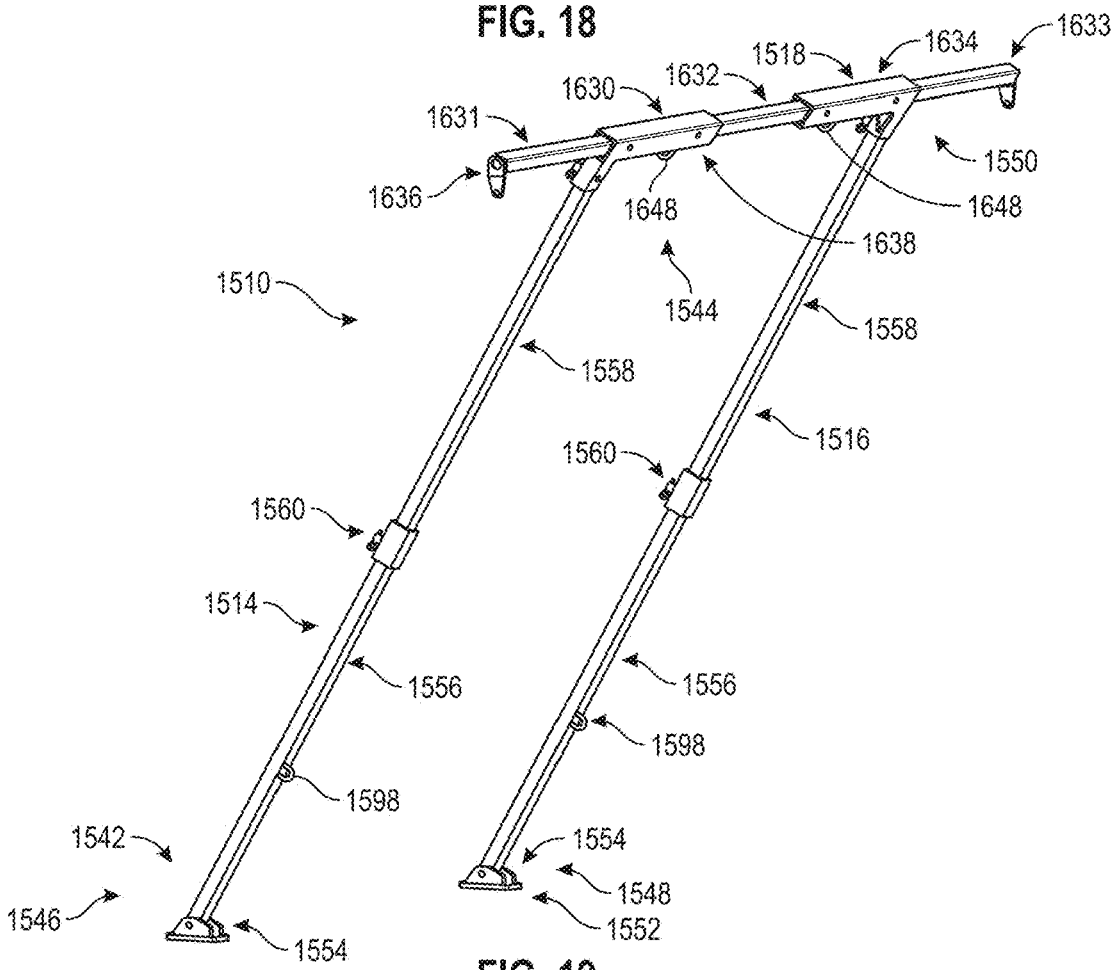
FIG. 19 is a perspective view of the system illustrated in FIG. 18.
Figure 20:
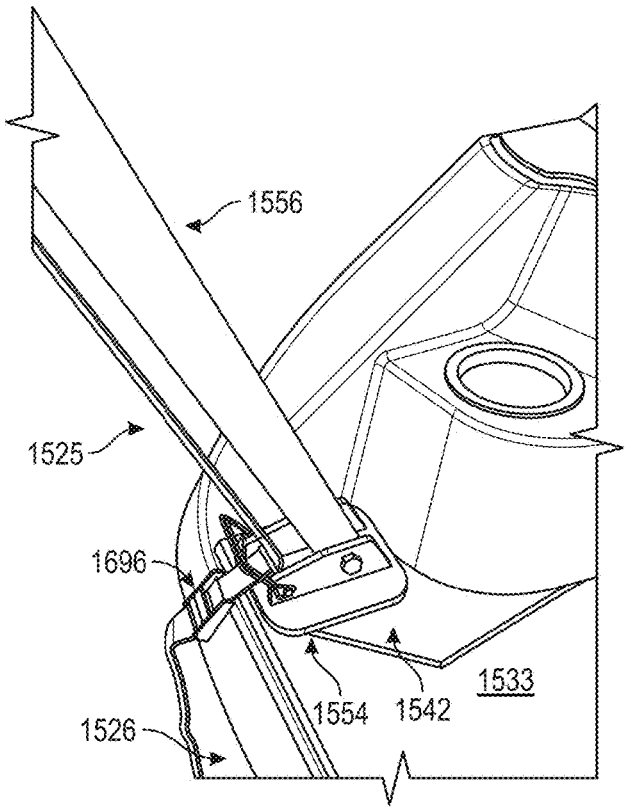
FIG. 20 is a partial perspective view of the first mounting mechanism of the system illustrated in FIG. 18.
Figure 21:
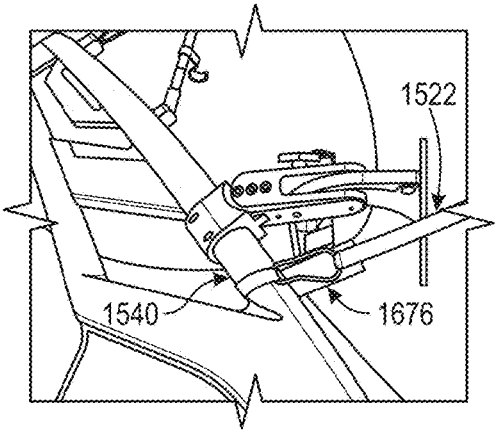
FIG. 21 is a partial perspective view of the third mounting member and the first flexible support member of the system illustrated in FIG. 18.
Figure 22:
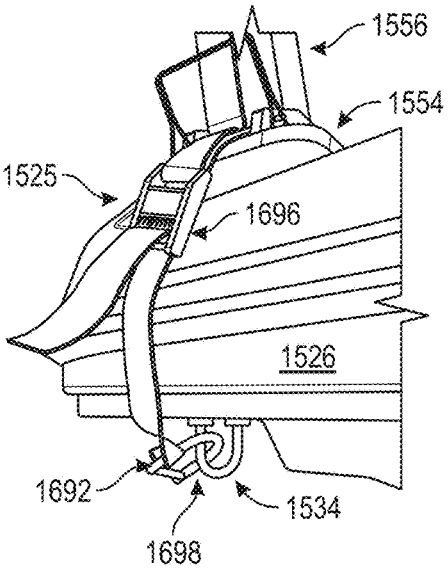
FIG. 22 is a partial perspective view of the first mounting mechanism and first mounting member of the system illustrated in FIG. 18.

In the illustrated embodiment, the first leg frame member 1514 is removably mounted in an elevated position on the stern 1526 and port side 1530 of the boat 1512 and the second leg frame member 1516 is removably mounted in an elevated position on the stern 1526 and starboard side 1530 of the boat 1512. The first leg frame member 1514 has a proximal first end 1542 and a distal first end 1544 in opposed relationship to the proximal first end 1542. The proximal first end 1542 includes a first mounting mechanism 1546 that is adapted to be removably mounted to the boat 1512 and the distal first end 1544 is adapted to be removably connected to the attachment device 1518. The second leg frame member 1516 has a proximal second end 1548 and a distal second end 1550 in opposed relationship to the proximal second end 1548. The proximal second end 1548 includes a second mounting mechanism 1552 that is adapted to be removably mounted to the boat 1512 and the distal second end 1550 is adapted to be removably connected to the attachment device 1518. As shown in FIGS. 18 and 19, when assembled, each of the distal first end 1544 and the distal second end 1550 extends beyond an extent (e.g., stern 1526) of the boat 1512.

In the illustrated embodiment, each of the first leg frame member 1514 and the second leg frame member 1516 includes base member 1554, an intermediate member 1556, a top member 1558, and a plurality of attachment members 1560. The base member 1554 is releasably mounted to the boat 1512, the intermediate member 1556 is pivotably attached to the base member 1554, and the top member 1558 is releasably attached to the intermediate member 1556.

Figure 28:
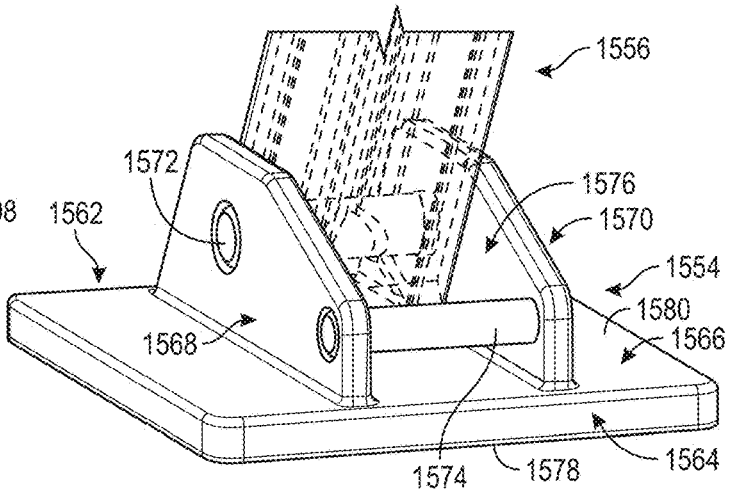
FIG. 28 is a partial perspective view of the base member and intermediate member of a leg frame member of the system illustrated in FIG. 18.
Figure 29:
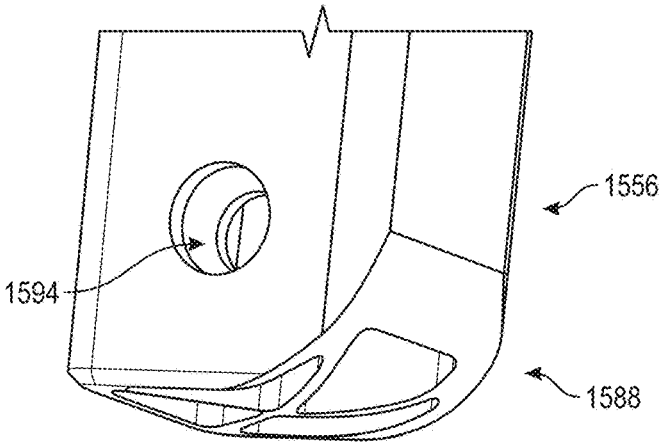
FIG. 29 is a magnified view of area E-E shown in FIG. 24.

The base member 1554 of the first leg frame member 1514 comprises the first mounting mechanism 1546 and the base member 1554 of the second leg frame member 1514 comprises the second mounting mechanism 1552. As shown in FIG. 28, the base member 1554 has a first end 1562, a second end 1564, a plate member 1566, a first projection 1568, a second projection 1570, a first pin 1572, a second pin 1574, and defines a recess 1576. The plate member 1566 has a bottom surface 1578 and a top surface 1580. Each of the first and second projections 1568, 1570 extends from the top surface 1580 of the plate member 1566 and away from the bottom surface 1578. Each of the first and second pins 1572, 1574 is disposed between the first and second projections 1568, 1570 and within the recess 1576. The first pin 1572 is disposed between the first and second ends 1562, 1564 of the base member 1554 and the second pin 1574 is disposed between the first pin 1572 and the second end 1564 of the base member 1554. The first pin 1572 is sized to be disposed through a portion of the intermediate member 1556 and the second pin 1574 is sized and positioned to prevent advancement of the intermediate member 1556 beyond the second pin 1574. For example, a second pin 1574 can be sized and positioned to prevent advancement of the intermediate member 1556 beyond between about 90 degrees and about 135 degrees relative to the swim platform 1533, or any other angle considered suitable for a particular embodiment.

The intermediate member 1556 is pivotably attached to the base member 1554 and the releasably attached to the top member 1558. As shown in FIGS. 24, 25, 26, 27, 28, and 29, the intermediate member 1556 is an elongate tubular member 1586 that has a first end 1588, a second end 1590, a first width 1589, a first depth 1591, and defines a passageway 1592, a first set of coaxial openings 1594, a second set of coaxial openings 1596, and a mounting bracket 1598. The first width 1589 and first depth 1591 are sized such that the first end 1588 can be disposed within the recess 1576 of the base member 1554 and the second end 1590 can be disposed within a portion of the top member 1558. In the illustrated embodiment, the first width 1589 is less than the first inside width 1611 of the top member 1558 and the first depth 1591 is less than the first inside depth 1613 of the top member 1558. The first set of coaxial openings 1594 is disposed near the first end 1588 and each opening sized to receive a portion of the first pin 1572 to accomplish attachment between the base member 1554 and the intermediate member 1556. Each opening of the second set of coaxial openings 1596 is disposed between the first end 1588 and the second end 1590 and is sized to receive a portion of an attachment member of the plurality of attachment members 1560 to accomplish attachment between the intermediate member 1556 and the top member 1558, as described herein. The mounting bracket 1598 is disposed on a side of the intermediate member 1556 opposing the boat 1512 when the system 1510 is assembled. The mounting bracket 1598 defines a passageway 1600 through which a portion of a flexible support member 1525, 1527 can be disposed. However, alternative embodiments can include any suitable structure on an intermediate member to accomplish attachment between an intermediate member and a flexible support member.

Figure 26:
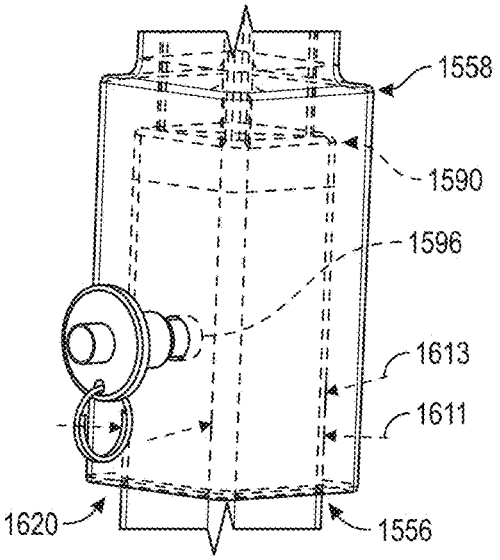
FIG. 26 is a partial perspective view of the intermediate member and top member of a leg frame member of the system illustrated in FIG. 18.
Figure 27:
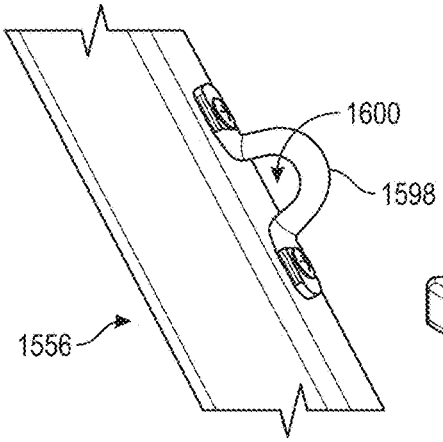
FIG. 27 is a magnified view of area D-D shown in FIG. 24.
Figure 30:
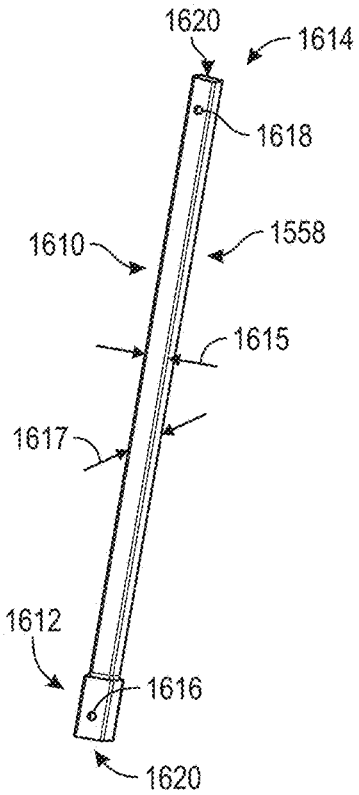
FIG. 30 is a perspective view of the top member of a leg frame member of the system illustrated in FIG. 18.
Figure 31:
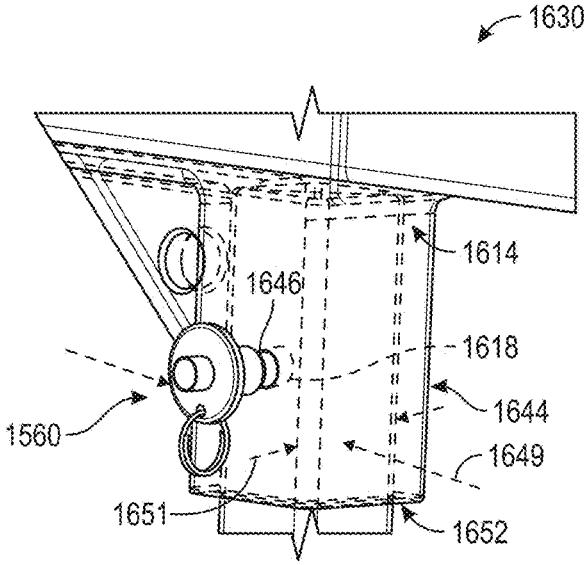
FIG. 31 is a partial perspective view of the top member of a leg frame member and of an end member of an attachment device of the system illustrated in FIG. 18.

The top member 1558 is releasably attached to the intermediate member 1556. As shown in FIGS. 26, 30 and 31, the top member 1558 is an elongate tubular member 1610 that has a first end 1612, a second end 1614, a first inside width 1611, a first inside depth 1613, a second width 1615, a second depth 1617, and defines a first set of coaxial openings 1616, a second set of coaxial openings 1618, and a passageway 1620. The first inside width 1611 and the first inside depth 1613 are sized such that the intermediate member 1556 can be partially disposed within the passageway 1620 of the top member 1558. The first inside width 1611 is greater than the first width 1589 of the intermediate member 1556 and the first inside depth 1613 is greater than the first depth 1591 of the intermediate member 1556. The second width 1615 and the second depth 1617 are sized such that the top member 1558 can be partially disposed within a passageway 1652 of a projection 1644 of an end member 1630, 1634. The second width 1615 is less than the first inside width 1649 of the projection 1644 and the second depth 1617 is less than the first inside depth 1651 of the projection 1644. Each opening of the first set of coaxial openings 1616 is disposed between the first end 1612 and the second end 1614 and is sized to receive a portion of an attachment member of the plurality of attachment members 1560 to accomplish attachment between the intermediate member 1556 and the top member 1558. Each opening of the second set of coaxial openings 1618 is disposed near the second end 1614 and is sized to receive a portion of an attachment member of the plurality of attachment members 1560 to accomplish attachment between the top member 1558 and the attachment device 1518, as described in more detail herein.

The attachment device 1518 is removably mounted between the first leg frame member 1514 and the second leg frame member 1516 and is adapted for operable attachment of at least one accessory, as described in more detail herein. In the illustrated embodiment, the attachment device 1518 includes a first end member 1630, an intermediate member 1632, a second end member 1634, a first extension member 1631, and a second extension member 1633. The first extension member 1631 is attachable to the first end member 1630 and the second extension member 1633 is attachable to the second end member 1634. When assembled, the attachment device 1518 comprises a horizontal arm 1636 that extends between the first leg frame member 1514 and the second leg frame member 1516.

Figure 33:
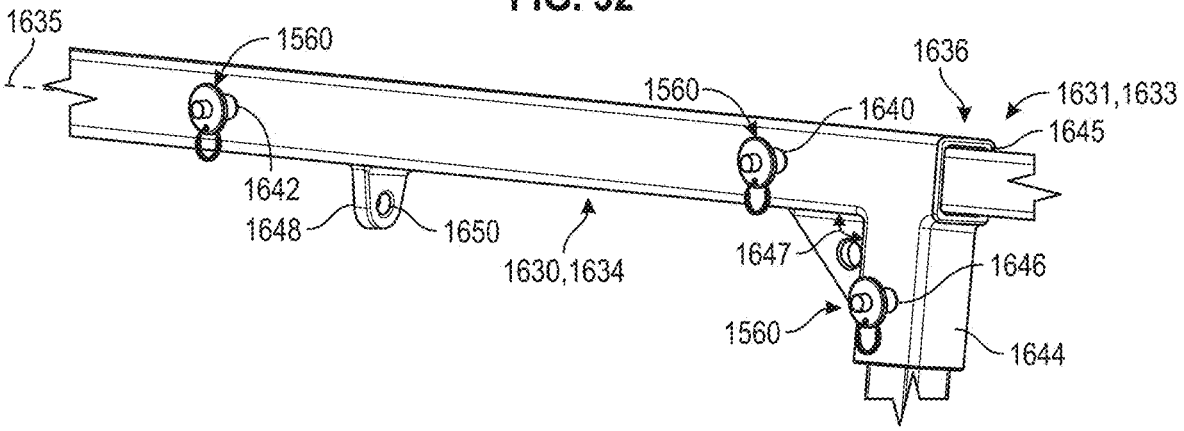
FIG. 33 is a partial perspective view of the attachment device of the system illustrated in FIG. 18.

As shown in FIGS. 19, 31, and 33, each of the first end member 1630 and the second end member 1634 has a lengthwise axis 1635, a first end 1636, a second end 1638, and defines a first set of coaxial openings 1640, a second set of coaxial openings 1642, a projection 1644, a third set of coaxial openings 1646, a passageway 1645, and a mounting bracket 1648 that defines an opening 1650. Each opening of the first set of coaxial openings 1640 is disposed between the first end 1636 and the second end 1638. Each opening of the first set of coaxial openings 1640 is sized to receive a portion of an attachment member 1560 to accomplish attachment between an end member 1630, 1634 and an extension member 1631, 1633. Each opening of the second set of coaxial openings 1642 is disposed between the second end 1638 and the first set of coaxial openings 1640. Each opening of the second set of coaxial openings 1642 is sized to receive a portion of an attachment member of the plurality of attachment members 1560 to accomplish attachment between the end member 1630, 1634 and the intermediate member 1632. The projection 1644 extends at an angle 1647 relative to the lengthwise axis 1635 and defines an inside width 1649, an inside depth 1651, and a passageway 1652 that extends through the projection 1644. The inside width 1649 and the inside depth 1651 are sized such that a portion of the top member 1558 can be disposed within the passageway 1652 of the projection 1644. The third set of coaxial openings 1646 is disposed on the projection 1644. Each opening of the third set of coaxial openings 1646 of the first end member 1630 is sized to receive a portion of an attachment member of the plurality of attachment members 1560 to accomplish attachment between the attachment device 1518 and a first leg frame member 1514. Each opening of the third set of coaxial openings 1646 of the second end member 1634 is sized to receive a portion of an attachment member of the plurality of attachment members 1560 to accomplish attachment between the attachment device 1518 and the second leg frame member 1516.

Figure 32:
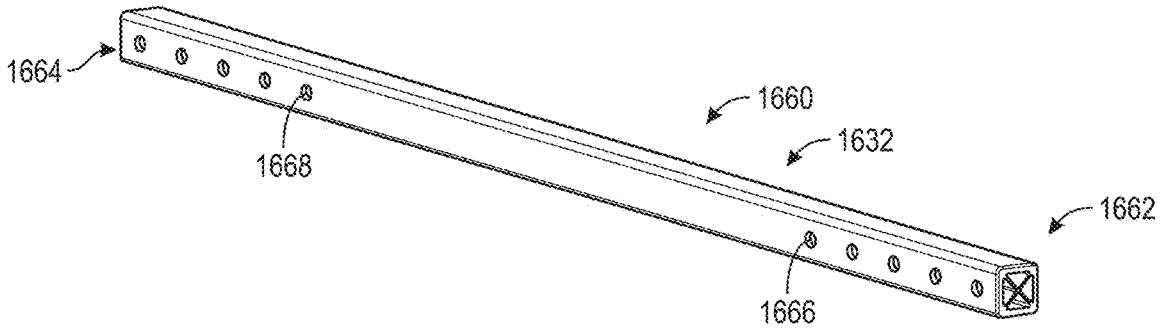
FIG. 32 is a perspective view of the intermediate member of the attachment device of the system illustrated in FIG. 18.

The intermediate member 1632 is a tubular member 1660 that is releasably attached to the first end member 1630 and the second end member 1632. As shown in FIGS. 19 and 32, the intermediate member 1632 is disposed within the first end member 1630 and the second end member 1632. The intermediate member 1632 has a first end 1662, a second end 1664, and defines a first plurality of coaxial openings 1666, and a second plurality of coaxial openings 1668. The first plurality of coaxial openings 1666 is disposed near the first end 1662 and the second plurality of coaxial openings 1668 is disposed near the second end 1664. Each opening of the first plurality of coaxial openings 1666 is sized to receive a portion of an attachment member of the plurality of attachment members 1560 to accomplish attachment between the intermediate member 1632 and the first end member 1630. Each opening of the second plurality of coaxial openings 1668 is sized to receive a portion of an attachment member of the plurality of attachment members 1560 to accomplish attachment between the intermediate member 1632 and the second end member 1634. The overall length of the attachment device 1518, and the distance between the first leg frame member 1514 and the second leg frame member 1516, can be customized depending on which set of openings of the first plurality of coaxial openings 1666 and the second plurality of coaxial openings 1668 are aligned with openings of the first end member 1630 and the second end member 1634 and through which the attachment members are disposed.

Figure 34:
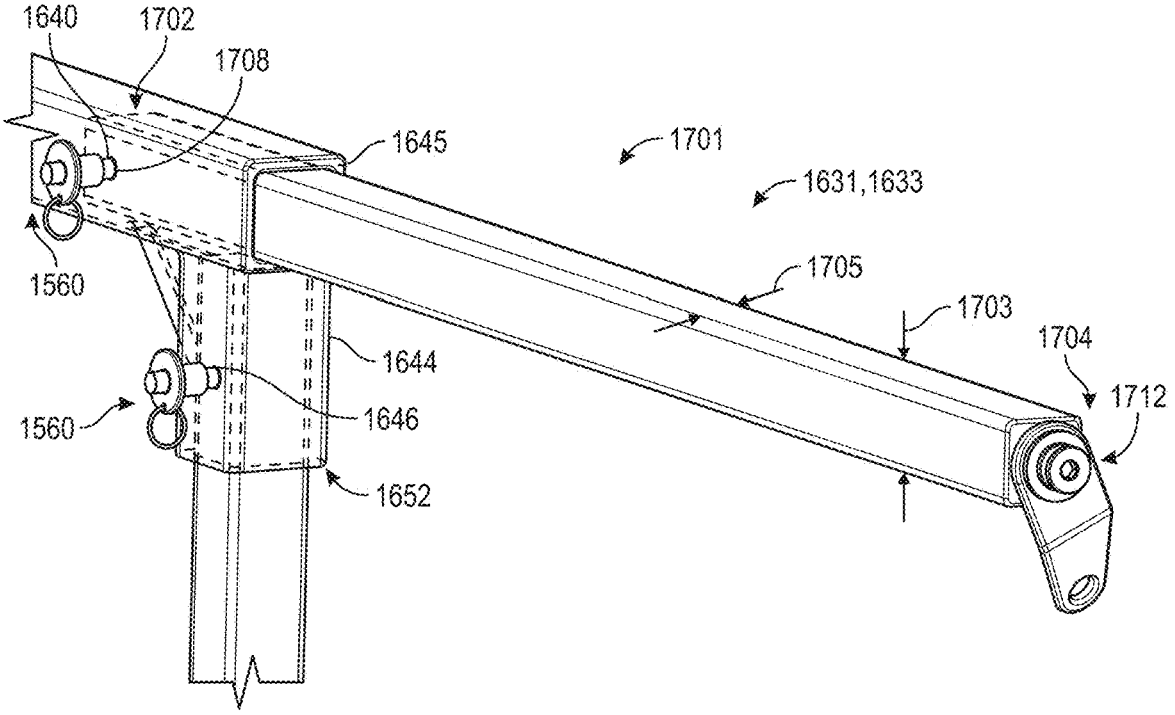
FIG. 34 is a partial perspective view of the attachment device of the system illustrated in FIG. 18.
Figure 35:
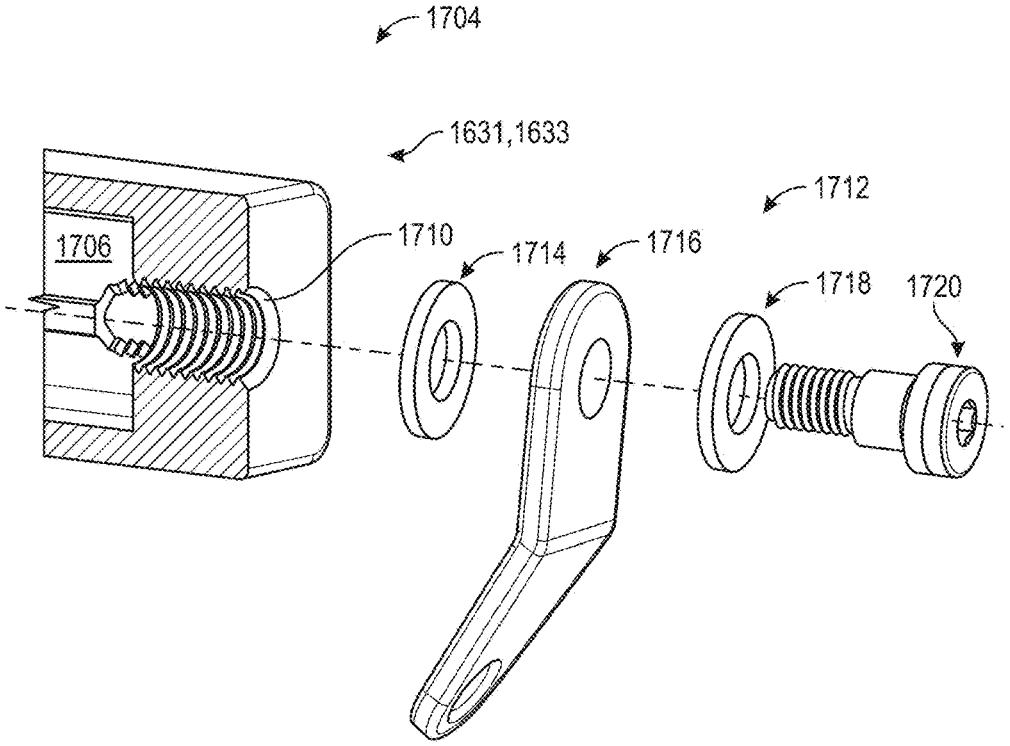
FIG. 35 is a partial perspective exploded view of the first end of an extension member of the attachment device of the system illustrated in FIG. 18.

The first extension member 1631 is releasably attached to the first end member 1630 and the second extension member 1633 is releasably attached to the second end member 1634. As shown in FIGS. 34 and 35, each of the first extension member 1631 and the second extension member 1633 is an elongate tubular member 1701 that has a first end 1702, a second end 1704, a first width 1703, a first depth 1705, and defines a passageway 1706, a first set of coaxial openings 1708, a threaded opening 1710, and a mounting member 1712. The first width 1703 and first depth 1705 are sized such that the first end 1702 can be disposed within the passageway 1645 of an end member 1630, 1634. The first set of coaxial openings 1708 is disposed near the first end 1702 and each opening sized to receive a portion of an attachment member 1560 to accomplish attachment between an extension member 1631, 1633 and an end member 1630, 1634. The threaded opening 1710 extends from the second end 1704 to the passageway 1706 and is sized to receive a portion of the mounting member 1712. The mounting member 1712 is disposed on the second end 1704 and includes a first o-ring 1714, a mounting bracket 1716, a second o-ring 1718, and a threaded attachment member 1720. The mounting bracket 1716 provides structure upon which an accessory can be attached, as described herein. The threaded attachment member 1720 is passed through the second o-ring 1718, the mounting bracket 1716, the first o-ring 1714, and into the threaded opening 1710 and is rotated to attach the mounting bracket 1716 to an extension member 1631, 1633.

The first flexible support member 1520 is adapted to connect the attachment device 1518 with a first portion of the boat 1512 that is spaced at a distance from the stern 1526 and/or the port side 1530 of the boat 1512. The second flexible support member 1522 is adapted to connect the attachment device 1518 with a second portion of the boat 1512 spaced at a distance from the stern 1526 and/or starboard side 1532 of the boat 1512. In the illustrated embodiment, the first flexible support member 1520 is removably connected to the first end member 1630 (e.g., is attachable to the mounting bracket 1648 of the first end member 1630, is attached to the mounting bracket 1648 of the first end member 1630) and the third mounting member 1538 disposed on the port side 1530 of the boat 1512 and the second flexible support member 1522 is removably connected to the second end member 1634 (e.g., is attachable to the mounting bracket 1648 of the first end member 1630, is attached to the mounting bracket 1648 of the first end member 1630) and the fourth mounting member 1540 disposed on the starboard side 1532 of the boat 1512. The second flexible support member 1522 is opposably positioned from the first flexible support member 1520 relative to the lengthwise axis 1523 of the boat 1512. As shown in FIG. 18, each of the first flexible support member 1520 and the second flexible support member 1522 has a first end 1670, a second end 1672, and an adjustment member 1674. In the illustrated embodiment, each of the first end 1670 and the second end 1672 comprises a hook 1676 that is sized to receive a portion of the boat 1512 and/or a portion of the system 1510.

The third flexible support member 1525 is adapted to connect the first leg frame member 1514 with a third portion of the boat 1512 that is disposed on the stern 1526 and/or the port side 1530 of the boat 1512. The fourth flexible support member 1527 is adapted to connect the second leg frame member 1516 with a fourth portion of the boat 1512 that is disposed on the stern 1526 and/or starboard side 1532 of the boat 1512. In the illustrated embodiment, the third flexible support member 1525 is removably connected to the first leg frame member 1514 and the first mounting member 1534 disposed on the port side 1530 of the boat 1512 and the fourth flexible support member 1527 is removably connected to the second leg frame member 1516 and the second mounting member 1536 disposed on the starboard side 1532 of the boat 1512. The fourth flexible support member 1527 is opposably positioned from the third flexible support member 1525 relative to the lengthwise axis 1523 of the boat 1512. Each of the third flexible support member 1525 and the fourth flexible support member 1527 has a first end 1692, a second end 1694, and an adjustment member 1696. In the illustrated embodiment, each of the first end 1692 and the second end 1694 comprises a hook 1698 that is sized to receive a portion of the boat 1512 and/or a portion of the system 1510.

To accomplish a method of assembling the system for attaching accessories to a boat or a marine environment 1510 and attaching the system 1510 to the boat 1512, the first leg frame member 1514 is assembled and attached to the boat 1512, the second leg frame member 1516 is assembled and attached to the boat 1512, the attachment device 1518 is assembled and attached to the first and second leg frame members 1514, 1516, the first flexible support member 1520 is attached to the attachment device 1518 and the boat 1512, the second flexible support member 1522 is attached to the attachment device 1518 and the boat 1512, the third flexible support member 1525 is attached to the first leg member 1514 and the boat 1512, and the fourth flexible support member 1527 is attached to the second leg member 1516 and the boat 1512. When assembled, the first and second leg frame members 1514, 1516 are disposed at an angle relative to the swim platform 1533 of the boat 1512 that is about, or greater than, 90 degrees (e.g., between about 90 degrees and about 120 degrees). However, a first leg frame member and/or a second leg frame member can be disposed at any suitable angle relative to a portion of a boat (e.g., swim platform), such as an obtuse, right, or acute angle.

To accomplish assembly of the first leg frame member 1514, the intermediate member 1556 is attached to the base member 1554 and the top member 1558 is attached to the intermediate member 1556. Attachment of the intermediate member 1556 to the base member 1554 is accomplished by advancing the intermediate member 1556 into the recess 1576 defined by the base member 1554 and positioning the first pin 1572 through the first set of coaxial openings 1594 of the intermediate member 1556. Attachment of the top member 1558 to the intermediate member 1556 is accomplished by advancing the intermediate member 1556 into the passageway 1620 of the top member 1558 until the second set of coaxial openings 1596 defined by the intermediate member 1566 is aligned with the first set of coaxial openings 1616 defined by the top member 1558. Then an attachment member of the plurality of attachment members 1560 is advanced through the openings of the top member 1558 and the intermediate member 1556 such that the top member 1558 and the intermediate member 1556 become releasably attached to one another.

To accomplish assembly of the second leg frame member 1516, the intermediate member 1556 is attached to the base member 1554 and the top member 1558 is attached to the intermediate member 1556. Attachment of the intermediate member 1556 to the base member 1554 is accomplished by advancing the intermediate member 1556 into the recess 1576 defined by the base member 1554 and positioning the first pin 1572 through the first set of coaxial openings 1594 of the intermediate member 1556. Attachment of the top member 1558 to the intermediate member 1556 is accomplished by advancing the intermediate member 1556 into the passageway 1620 of the top member 1558 until the second set of coaxial openings 1596 defined by the intermediate member 1566 is aligned with the first set of coaxial openings 1616 defined by the top member 1558. Then an attachment member of the plurality of attachment members 1560 is advanced through the openings of the top member 1558 and the intermediate member 1556 such that the top member 1558 and the intermediate member 1556 become releasably attached to one another.

To accomplish attachment of the first leg frame member 1514 to the boat 1512, the base member 1554 is positioned on the swim platform 1533. The second end 1694 of the third flexible support member 1525 is then passed between the second pin 1574 and the plate member 1566 and is attached to the mounting bracket 1598. The first end 1692 of the third flexible support member 1525 is then attached to the first mounting member 1534 and the third flexible support member 1525 is tightened using the adjustment member 1696. To accomplish attachment of the second leg frame member 1516 to the boat 1512, the base member 1554 is positioned on the swim platform 1533. The second end 1694 of the fourth flexible support member 1527 is then passed between the second pin 1574 and the plate member 1566 and is attached to the mounting bracket 1598. The first end 1692 of the fourth flexible support member 1527 is then attached to the second mounting member 1536 and the fourth flexible support member 1527 is tightened using the adjustment member 1696. The process of attaching the first leg frame member 1514 and/or the second leg frame member 1516 to the boat 1512 can be accomplished prior, or subsequent, to assembling the first leg frame member 1512, the second leg frame member 1516, the attachment device 1518, and/or attaching the attachment device 1518 to the first and second leg frame members 1512, 1514.

To accomplish assembly of the attachment device 1518, the first end member 1630 is attached to the intermediate member 1632 and the second end member 1634 is attached to the intermediate member 1632. Attachment of the first end member 1630 to the intermediate member 1632 is accomplished by advancing the intermediate member 1632 into the first end member 1630 until a desired set of openings of the first plurality of coaxial openings 1666 of the intermediate member 1632 is aligned with the second set of coaxial openings 1642 of the first end member 1630. Then an attachment member of the plurality of attachment members 1560 is advanced through the openings such that the first end member 1630 and the intermediate member 1632 become releasably attached to one another. Attachment of the second end member 1634 to the intermediate member 1632 is accomplished by advancing the intermediate member 1632 into the second end member 1632 until a desired set of openings of the second plurality of coaxial openings 1668 of the intermediate member 1632 is aligned with the second set of coaxial openings 1642 of the second end member 1634. Then an attachment member of the plurality of attachment members 1560 is advanced through the openings such that the second end member 1634 and the intermediate member 1632 become releasably attached to one another.

To accomplish assembly of the attachment device 1518 to the first and second leg frame members 1514, 1516, the first end member 1630 is attached to the first leg frame member 1514 and the second end member 1632 is attached to the second leg frame member 1516. Attachment of the first end member 1630 to the first leg frame member 1514 is accomplished by advancing the top member 1558 into the passageway 1652 defined by the projection 1644 of the first end member 1630 until the second set of coaxial openings 1618 of the top member 1558 are aligned with the third set of coaxial openings 1646 defined by the first end member 1630. Then an attachment member of the plurality of attachment members 1560 is advanced through the openings such that the top member 1558 and the first end member 1630 become releasably attached to one another. Attachment of the second end member 1634 to the second leg frame member 1516 is accomplished by advancing the top member 1558 into the passageway 1652 defined by the projection 1644 of the second end member 1634 until the second set of coaxial openings 1618 of the top member 1558 are aligned with the third set of coaxial openings 1646 defined by the second end member 1634. Then an attachment member of the plurality of attachment members 1560 is advanced through the openings such that the top member 1558 and the first end member 1630 become releasably attached to one another. The process of attaching the attachment device 1518 to the first leg frame member 1514 and/or the second leg frame member 1516 and/or assembling the attachment device 1518 can be accomplished prior, or subsequent, to assembling the first leg frame member 1514, the second leg frame member 1516, attaching the first leg frame member 1514 to the boat 1512, and/or attaching the second leg frame member 1516 to the boat 1512.

To accomplish attachment of the first flexible support member 1520 to the attachment device 1518 and the boat 1512 the first end 1670 of the first flexible support member 1520 is attached to the attachment device 1518 and the second end 1672 of the first flexible support member 1520 is attached to the boat 1512. In the illustrated embodiment, the hook 1676 disposed on the first end 1670 is positioned within the passageway 1650 defined by the mounting bracket 1648 of the first end member 1630 and the hook 1676 disposed on the second end 1670 is positioned within an opening 1541 defined by the third mounting member 1538. To accomplish attachment of the second flexible support member 1522 to the attachment device 1518 and the boat 1512 the first end 1670 of the second flexible support member 1522 is attached to the attachment device 1518 and the second end 1672 of the second flexible support member 1522 is attached to the boat 1512. In the illustrated embodiment, the hook 1676 disposed on the first end 1670 is positioned within the passageway 1650 defined by the mounting bracket 1648 of the second end member 1634 and the hook 1676 disposed on the second end 1670 is positioned within an opening 1543 defined by the fourth mounting member 1540. Optionally, the first and second flexible support members 1520, 1522 can be adjusted using the adjustment member 1674 to tighten or loosen the attachment between the leg frame members 1514, 1516 and the boat 1512.

Attachment of the first extension member 1631 to the first end member 1630 can be accomplished by positioning the first end 1702 of the first extension member 1631 into the passageway 1645 of the first end member 1630 and aligning the first set of coaxial openings 1708 of the first extension member 1631 with the first set of coaxial openings 1640 of the first end member 1630. Then an attachment member of the plurality of attachment members 1560 is advanced through the openings such that the first extension member 1631 and the first end member 1630 become releasably attached to one another. Attachment of the second extension member 1633 to the second end member 1634 can be accomplished by positioning the first end 1702 of the second extension member 1633 into the passageway 1645 of the second end member 1634 and aligning the first set of coaxial openings 1708 of the second extension member 1633 with the first set of coaxial openings 1640 of the second end member 1634. Then an attachment member of the plurality of attachment members 1560 is advanced through the openings such that the second extension member 1633 and the second end member 1634 become releasably attached to one another.

Figure 23:
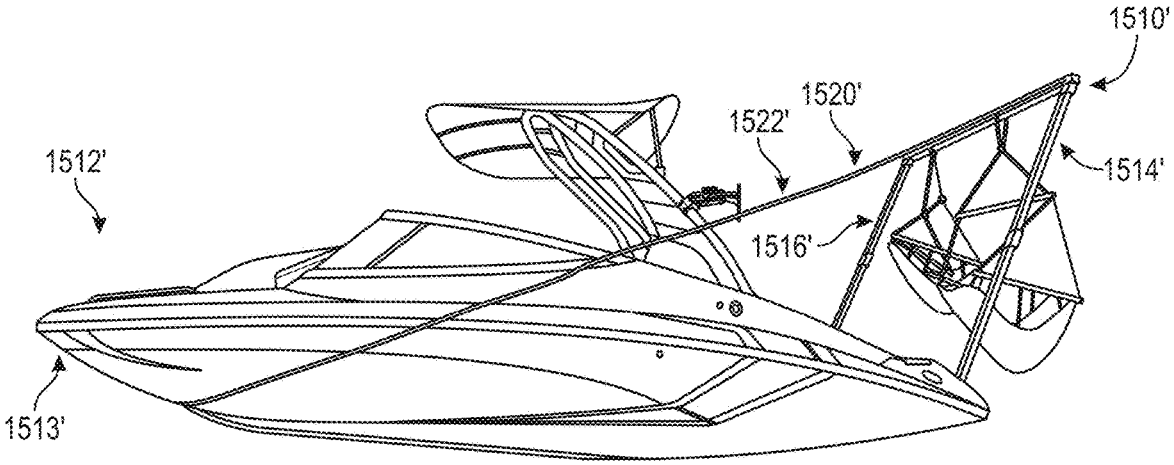
FIG. 23 is a partial perspective view of an alternative method for attaching the system illustrated in FIG. 18 to a boat.
Figure 24:
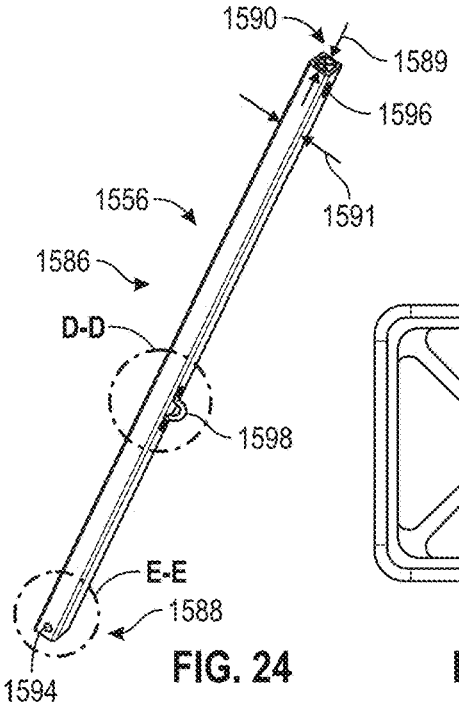
FIG. 24 is a perspective view of the intermediate member of a leg frame member of the system illustrated in FIG. 18.
Figure 25:
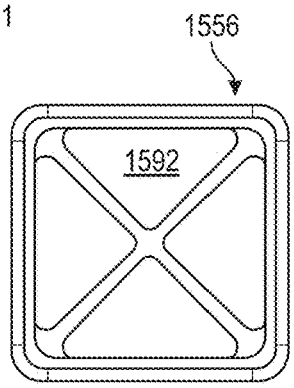
FIG. 25 is a top view of the intermediate member illustrated in FIG. 24.

While particular components of the systems for attaching accessories to a boat described herein have been illustrated as being attached at a particular location and/or to a particular part of a boat, the components of a system for attaching an accessory to a boat or a marine environment can be attached to any suitable location and/or part of a boat. For example, FIG. 23 illustrates an alternative method for attaching the system for attaching accessories to a boat or a marine environment 1510' to the boat 1512'. As shown in FIG. 23, the first flexible support member 1520' is attached to the first leg frame member 1514' and underneath the hull 1513' and the second flexible support member 1522' is attached to the second leg frame member 1516' and underneath the hull 1513'.

The systems for attaching an accessory to a boat described herein provide a mechanism to attach one or more accessories to a boat quickly and bear the weight of any attached accessory and items, or users, disposed on the accessory. In addition, the systems described herein provide additional seating and/or storage space that is typically very limited on boats, especially on the aft portion of the boat where users typically congregate when a boat is stopped or anchored. Furthermore, the systems described herein allow for an accessory to be elevated and/or positioned beyond an extent (e.g., the stern) of the boat.

Those with ordinary skill in the art will appreciate that various modifications and alternatives for the described and illustrated embodiments can be developed in light of the overall teachings of the disclosure, and that the various elements and features of one example described and illustrated herein can be combined with various elements and features of another example without departing from the scope of the invention. Accordingly, the particular examples disclosed herein have been selected by the inventor(s) simply to describe and illustrate examples of the invention and are not intended to limit the scope of the invention or its protection, which is to be given the full breadth of the appended claims and any and all equivalents thereof.

What is claimed is:

1. A system for attaching accessories to a boat or a marine environment comprising:

a first leg frame member having a base member, an intermediate member, and a top member, the intermediate member of the first leg frame member releasably attached to the base member of the first leg frame member, and the top member of the first leg frame member releasably attached to the intermediate member of the first leg frame member;

a second leg frame member having a base member, an intermediate member, and a top member, the intermediate member of the second leg frame member releasably attached to the base member of the second leg frame member, and the top member of the second leg frame member releasably attached to the intermediate member of the second leg frame member;

an attachment device removably mounted to the first leg frame member and the second leg frame member;

a first flexible support member removably connected to one of the first leg frame member or the attachment device;

a second flexible support member removably connected to one of the second leg frame member or the attachment device; and an accessory attached to the attachment device, the accessory comprising a chair.

2. The system of claim 1, wherein the intermediate member of the first leg frame member is pivotably attached to the base member of the first leg frame member.

3. The system of claim 1, wherein the intermediate member of the second leg frame member is pivotably attached to the base member of the second leg frame member.

4. The system of claim 1, wherein the first leg frame member is telescopic.

5. The system of claim 1, wherein the second leg frame member is telescopic.

6. The system of claim 1, wherein the attachment device has a first end member, an intermediate member, and a second end member, the intermediate member of the attachment device attached to the first end member and the second end member.

7. The system of claim 6, wherein the attachment device has a first extension member and a second extension member, the first extension member attached to the first end member, the second extension member attached to the second end member.

8. The system of claim 6, wherein the first end member has a mounting bracket; and wherein the first flexible support member is attached to the mounting bracket of the first end member.

9. The system of claim 6, wherein the second end member has a mounting bracket; and wherein the second flexible support member is attached to the mounting bracket of the second end member.

10. The system of claim 1, wherein the first leg frame member, the second leg frame member, and the attachment device are moveable between a first, expanded configuration and a second, collapsed configuration.

11. The system of claim 1, further comprising a storage container within which each of the first leg frame member, the second leg frame member, the attachment device, the first flexible support member, and the second flexible support member are disposed.

12. The system of claim 1, further comprising a third flexible support member removably connected to the first leg frame member.

13. The system of claim 12, further comprising a fourth flexible support member removably connected to the second leg frame member.

14. A system for attaching accessories to a boat or a marine environment comprising:

a first leg frame member having a base member, an intermediate member, and a top member, the intermediate member of the first leg frame member pivotably attached to the base member of the first leg frame member, and the top member of the first leg frame member attachable to the intermediate member of the first leg frame member;

a second leg frame member having a base member, an intermediate member, and a top member, the intermediate member of the second leg frame member pivotably attached to the base member of the second leg frame member, and the top member of the second leg frame member attachable to the intermediate member of the second leg frame member;

an attachment device mountable to the first leg frame member and the second leg frame member, the attachment device having a first end member, an intermediate member, and a second end member, the intermediate member of the attachment device attachable to the first end member and the second end member;

a first flexible support member attachable to one of the first leg frame member or the attachment device;

a second flexible support member attachable to one of the second leg frame member or the attachment device; and an accessory attachable to the attachment device, the accessory comprising a chair.

15. The system of claim 14, wherein the first end member has a mounting bracket;

wherein the first flexible support member is attachable to the mounting bracket of the first end member;

wherein the second end member has a mounting bracket; and wherein the second flexible support member is attachable to the mounting bracket of the second end member.

16. The system of claim 14, wherein the first leg frame member, the second leg frame member, and the attachment device are moveable between a first, expanded configuration and a second, collapsed configuration.

* * * * *